US007871343B2

(12) United States Patent
Blades

(10) Patent No.: US 7,871,343 B2
(45) Date of Patent: Jan. 18, 2011

(54) TENNIS BALL RETRIEVER

(76) Inventor: Frederick K. Blades, 2450 Fourmile Canyon, Boulder, CO (US) 80302

( * ) Notice: Subject to any disclaimer, the term of this patent is extended or adjusted under 35 U.S.C. 154(b) by 0 days.

(21) Appl. No.: 12/591,973

(22) Filed: Dec. 7, 2009

(65) Prior Publication Data

US 2010/0087280 A1 Apr. 8, 2010

Related U.S. Application Data

(63) Continuation-in-part of application No. 12/318,509, filed on Dec. 30, 2008, now abandoned, which is a continuation-in-part of application No. 11/257,135, filed on Oct. 25, 2005, now abandoned.

(60) Provisional application No. 60/623,220, filed on Nov. 1, 2004.

(51) Int. Cl.
*A63B 47/02* (2006.01)

(52) U.S. Cl. ..... 473/553; 473/517

(58) Field of Classification Search ..... 473/524, 473/553, 517; 224/248; 294/19.2; 56/328.1; D21/729
See application file for complete search history.

(56) References Cited

U.S. PATENT DOCUMENTS

| | | | | | |
|---|---|---|---|---|---|
| 1,212,909 | A * | 1/1917 | Cooper | 56/328.1 |
| 2,074,180 | A * | 3/1937 | Hatley | 224/248 |
| 2,110,084 | A * | 3/1938 | Heimers | 473/463 |
| 2,205,345 | A * | 6/1940 | Christensen | 294/19.2 |
| 2,628,804 | A * | 2/1953 | Goodman | 473/554 |
| 3,712,658 | A * | 1/1973 | Yaresh | 294/19.2 |
| 3,989,247 | A * | 11/1976 | Zimmerman | 473/517 |
| 4,256,244 | A * | 3/1981 | Gasper | 224/666 |
| 2006/0094545 | A1 * | 5/2006 | Blades | 473/524 |
| 2009/0176606 | A1 * | 7/2009 | Blades | 473/517 |

* cited by examiner

*Primary Examiner*—Raleigh W. Chiu
(74) *Attorney, Agent, or Firm*—Michael de Angeli

(57) ABSTRACT

A spring wire loop is affixed to a tennis racquet to enable a player to conveniently scoop a tennis ball off the playing surface and retrieve it. In one add-on embodiment, the loop can be affixed by mounts secured to the strings of an existing racquet; in another it is held in place by the racquet's bumper guard; in a further alternative, the loop can be secured to mounts built into the racquet at manufacture.

41 Claims, 11 Drawing Sheets

TENNIS BALL RETRIEVER

CROSS-REFERENCE TO RELATED APPLICATION

This application is a continuation-in-part of Ser. No. 12/318,509, filed Dec. 30, 2008, now abandoned which was a continuation-in-part of Ser. No. 11/257,135, filed Oct. 25, 2005, now abandoned which claims priority from provisional application Ser. No. 60/623,220, filed Nov. 1, 2004.

FIELD OF THE INVENTION

The present invention relates to a novel device and method enabling players of racquet sports, such as tennis, to retrieve a ball from the court surface with high style and minimal effort.

BACKGROUND OF THE INVENTION

The challenge of picking up a tennis ball from the playing surface other than by grasping it by one's hand is not a great one. A beginning tennis player quickly learns to pick up a ball by rolling it against the side of his shoe with his racquet so as to grasp the ball between the racquet and shoe, lifting the ball by bending his knee, letting it drop and bounce once and then striking it down with the racquet to bounce it high enough to catch it. Many experienced players can pick up a ball by striking down on the ball with the racquet and then increasing the height of the bounce using synchronous repetitive strikes until the ball bounces high enough to be caught. However, because the former method is awkward and the latter method difficult, it is not uncommon for players to simply stoop over to pick up the ball, which can be a nuisance over the course of a long playing session.

A number of devices for being attached to tennis racquets to allow balls to be retrieved without stooping over are known in the prior art. U.S. Pat. No. 5,947,850 issued to Gray describes a device that detachably mounts to the frame of a tennis racquet, comprising a pair of wire tines which when pressed over a tennis ball serve to capture the ball and lift it off the playing surface. The player then extracts the ball from the tines with his other hand. While this prevents the player from having to stoop down to pick up the ball, the device may interfere with play because it extends beyond the length of the racquet. It also suffers from an awkward appearance, and requires the player to manually extract the ball from the ball-capture mechanism.

Another known approach to retrieving tennis balls is to attach a device to the end of the handle of the racquet that is capable of attaching to the felt-like "nap" surface material typical of tennis balls. U.S. Pat. No. 5,333,854 issued to Woolard et al uses a plurality of miniature teeth or pins mounted in a cap that is attached to the handle of a racquet adapted to grasp the nap surface of the ball and thereby allow the player to lift the ball. U.S. Pat. No. 5,056,786, issued to Bellettini et al, uses a hooked fabric on the end of the racquet handle to attach to tennis balls that are fitted with a covering of intermeshing material. Yet another method, disclosed in U.S. Pat. No. 4,815,738 issued to DiFranco, uses an expanding petal mechanism that expands when pressed on to a ball thereby forcing pins into the nap covering the ball. All of these mechanisms have the disadvantage of requiring the player to invert the racquet, press the end onto the ball, raise the racquet to extract the ball, and then re-invert the racquet to again play tennis.

Yet another approach to retrieving tennis balls is described in U.S. Design Pat. No. 355,232 issued to Hodges. Hodges discloses a tennis racquet design that incorporates a recess in the rim of the racquet that serves to hold a tennis ball when pressed down upon it. Again the player must manually retrieve the ball from the ball capture mechanism.

Zimmerman U.S. Pat. No. 3,989,247 discloses several embodiments of devices to be attached to or built into tennis racquets for picking up balls. Each involves a loop of wire spaced away from the rim and strings of the racquet so that a ball can be captured by forcing it between the wire loop and rim. The loop must be manually deployed prior to each use, the ball withdrawn therefrom after capture, and the loop then returned to the inactive position. The inconvenience of this process would appear clearly to outweigh any convenience realized in not having to stoop over for the ball.

It is therefore an object of the present invention to provide an improved device and simple method for picking up a tennis ball (or the ball used in other racquet sports) from the playing surface. More specifically, it is an object of the invention to provide a simple and inexpensive device that can be affixed to a tennis racquet to enable easy and convenient picking-up of balls, without interference with the function of the racquet during play, and without requiring any steps to be taken to deploy the device for use, or to return it to an inactive position after such use.

SUMMARY OF THE INVENTION

The present invention, referred to herein as the "Scoop", comprises an approximately parabolic loop of spring wire affixed to a tennis racquet. The parabolic loop of wire is carefully shaped and located so as to enable a player to conveniently scoop a tennis ball off the playing surface and flip the ball into the air so as to be readily caught without difficulty. The wire is permanently deployed in the active ball-retrieving position, but is sufficiently light and resilient that it does not interfere with play.

Several distinct embodiments of this invention are disclosed in the present application, each providing substantially the same spring wire loop positioned in substantially the same location on the racquet. The embodiments differ chiefly in the manner in which the spring wire is attached to the racquet.

The first embodiment is an "add-on" Scoop that comprises an initially straight length of spring wire the ends of which are received by resilient mounts, the resilient mounts being adapted to be readily affixed to the strings of a tennis racquet. During installation the spring wire is flexed into an approximately parabolic shape. This add-on embodiment that attaches to the strings has the advantage that no modifications to the racquet are necessary and the product can therefore be marketed and sold as an "add-on" racquet accessory.

The second and third embodiments of the present invention are "built-in" versions, so-called because they require some modification to be "built-in" to the racquet frame at manufacture. Each of these two embodiments makes use of receptacles permanently installed on the racquet frame and adapted to receive and support the two ends of an initially straight spring wire adapted with plugs on each end. To install the loop, the spring wire is flexed and the plugs inserted into the receptacles to form an approximately parabolic shape which is used to scoop up the tennis ball. The tension of the deflected spring wire helps to hold it in place during play and the spring wire itself can be conveniently removed or added at any time. While these two embodiments offer some performance and appearance advantages over the add-on Scoop, they each require receptacles to be installed in the racquet frame which may entail drilling and like operations best performed during racquet manufacture.

The fourth and fifth embodiments of the present invention are referred to as "bumper" versions because they make advantageous use of the "bumper guard" that is commonly provided with a new tennis racquet. More specifically, the typical factory-supplied bumper guard protects the end of the racquet from scrapes against the playing surface and usually doubles as a "grommet strip", in that it also includes molded-in plastic tubes that extend through the frame holes to protect the strings from damage due to abrasion occasioned by rubbing against the edges of the string holes in the typically abrasive frame material. Bumper guards are usually specific to each racquet model and can be purchased separately and replaced as needed when the racquet is re-strung.

Thus, in the fourth embodiment, a length of spring wire is provided with a short portion at each end bent at an angle to facilitate its mounting in specially modified bumper guards. This particular shape naturally maintains the approximately parabolic loop formed at a predetermined angle with respect to the string plane when installed and can be flipped back and forth for storage and to change from right-hand to left-hand play. Several different means and methods of adapting a typical bumper guard to retain the spring wire are disclosed.

The fifth embodiment makes use of a "D"-shaped spring wire that is also retained by specially modified bumper guards and offers the particular advantage that if it happens to become partially or completely dislodged during play no sharp spring wire ends are exposed which might otherwise pose some danger of injury to the players. For this reason, this embodiment is well suited to versions that allow easy installation and removal of the spring wire by the player. Again, a number of different means and methods for adapting bumper guards to retain the D-loop spring wire are disclosed.

In the final embodiment of the invention, the ends of a length of wire are bent back so as to form triangular end sections. A hypotenuse portion of each triangular end section is retained in a channel formed under the bumper, typically by gluing a small plastic member between the bumper guard and racquet frame. This embodiment has the advantage that in this way the Scoop can be added to an existing racquet in a matter of minutes, which is helpful in encouraging players to try the Scoop.

Although the Scoop is described in this patent application with relation to tennis, the same device and method can be applied to advantage in other racquet sports such as squash or racquetball by adjusting the size of the wire loop to accommodate the different size balls and racquets.

Accordingly, where reference is made in this application and the appended claims to tennis, tennis racquets, tennis balls, or the like, these are to be understood to include all other racquet sports where similar problems are encountered, e.g., squash, racquetball, and all forms of tennis per se, e.g., lawn tennis, court tennis, paddle tennis, and the like.

BRIEF DESCRIPTION OF THE DRAWINGS

The invention will be better understood if reference is made to the accompanying drawings, in which:

FIG. 46 shows a D-loop spring wire with a raised retention means molded on.

FIG. 49 shows a D-loop spring wire with thin strip retention means molded on.

DETAILED DESCRIPTION OF THE PREFERRED EMBODIMENTS

Figure 1:
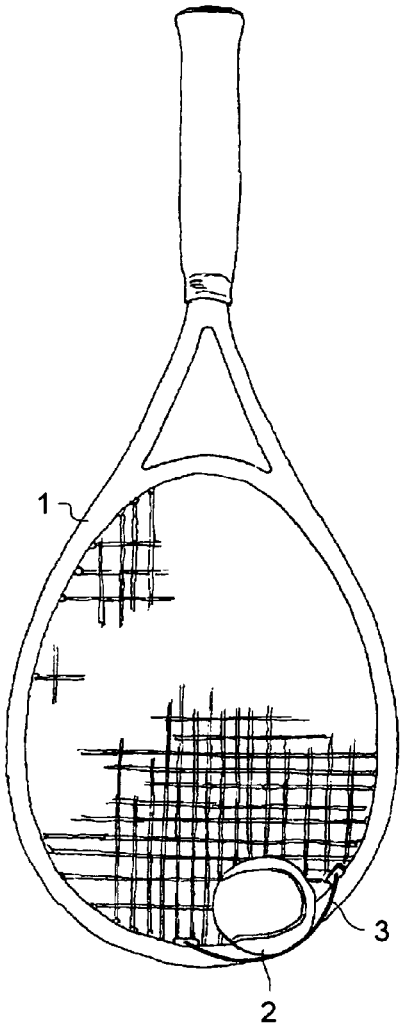
FIG. 1 shows a tennis racquet with the add-on Scoop holding a tennis ball.
Figure 2:
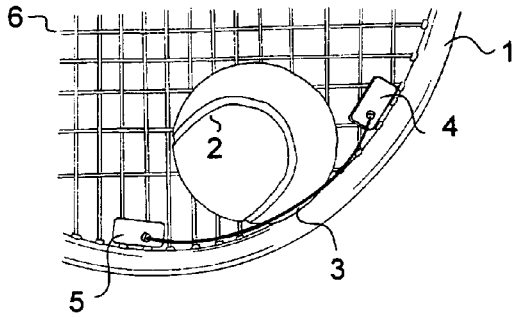
FIG. 2 shows an enlarged view of the add-on Scoop and ball, essentially as in FIG. 1.

Referring to FIG. 1 and the expanded view of FIG. 2, the "add-on" Scoop comprises a parabolic loop of spring wire 3 and two mounts 4 and 5 whereby the loop of wire can be affixed to a tennis racquet. In this embodiment, the Scoop is "detachable" from the racquet in that no permanent connection is made that would prevent its later removal, and no modification is necessary to the racquet. However, in ordinary use, including play, storage, and transport, the Scoop need not be removed from the racquet.

As shown, and as discussed in detail below, this parabolic loop of wire 3 is carefully shaped so as to retain a tennis ball 2 resting against the surface of the racquet strings 6, even when the racquet is substantially vertical, so that the ball can be picked up simply by sliding the wire under the ball and lifting the racquet. Two additional perspective views of the add-on Scoop in FIGS. 5 and 6 help to better illustrate the shape and position of the spring wire 3 relative to the racquet 1 and the ball 2.

As detailed further below, in this embodiment mounts 4 and 5 are adapted to be mounted conveniently on the racquet strings 6 without the use of tools, and without modifying the racquet, while supporting the spring wire 3 by its ends. The mounts 4 and 5 are spaced with respect to the length of the wire 3 so that the wire is forced to form a roughly parabolic loop. As illustrated, the wire loop is located slightly off the center line of the racquet to best position it for the player to scoop the ball off the surface using a natural swinging motion (see discussion of FIG. 11 below).

Figure 3:
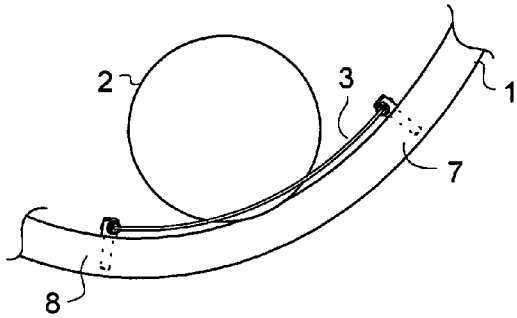
FIG. 3 shows a similar enlarged view of a first embodiment of the built-in Scoop.

FIG. 3 shows a first embodiment of the built-in Scoop from the same expanded viewpoint as the add-on Scoop of FIG. 2 but with the racquet strings omitted for clarity. This built-in Scoop differs from the add-on Scoop in that the spring wire 3 is supported by two receptacle mounts 7 and 8 that are built into the inside edge of the racquet frame 1. A plug affixed to one end of the initially straight spring wire 3 is inserted into one receptacle 7; the wire is then deformed, that is, curved, simply by bringing the second end closer to the fixed end, so that a plug on the second end can be inserted into a second receptacle 8. As above, the spacing of the receptacles and the length of the wire cooperate so that an approximately parabolic loop is formed, which can then be used to scoop up the tennis ball. One advantage of this embodiment is that because the receptacles mount in holes on the inside rim of the racquet that are in line with the string holes, there is little likelihood that these additional two holes will adversely affect the structural integrity of the racquet frame.

Figure 4:
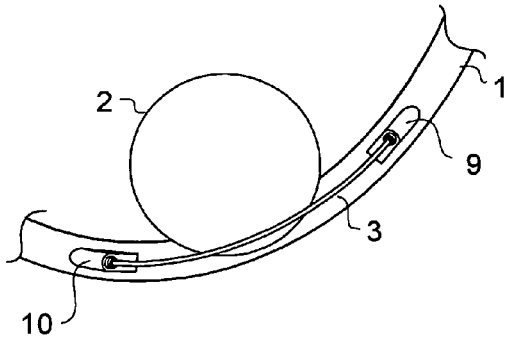
FIG. 4 shows a similar enlarged view of a second embodiment of the built-in Scoop.

FIG. 4 shows a second embodiment of the built-in Scoop, this one having resilient receptacle mounts 9 and 10 mounted on an outer edge of the frame of the racquet. Again, a fitting on one end of the initially straight spring wire 3 is inserted into one receptacle 9; the wire is then deformed to allow insertion of the other end into the other receptacle 10. The spacing of the receptacles and the length of the wire cooperate so that an approximately parabolic loop of wire is formed, which is then used to scoop up the tennis ball. This embodiment works exceptionally well in practice but may involve some additional consideration of the structural integrity of the racquet frame.

Although the add-on Scoop and the two built-in Scoops differ in the means employed to support the spring wire, the resulting shape and position of the wire loop formed is substantially the same and the wire loop is used in substantially the same manner to pick up a tennis ball. These three different physical embodiments are disclosed, and are discussed in further detail below, because each offers particular features and advantages with respect to manufacturing and/or marketing the product.

Figure 7:
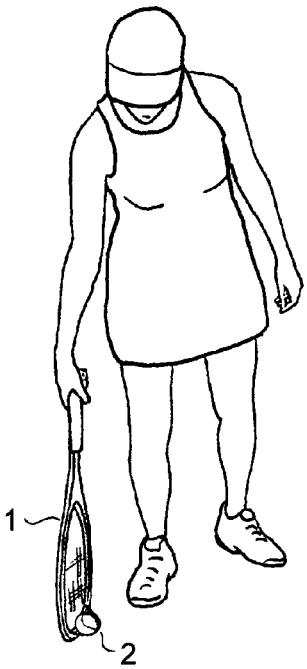
FIGS. 7-10 show a player using the Scoop to retrieve a tennis ball from the playing surface.
Figure 8:
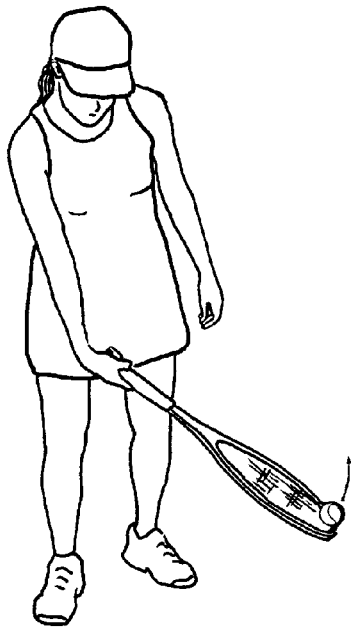
Figure 9:
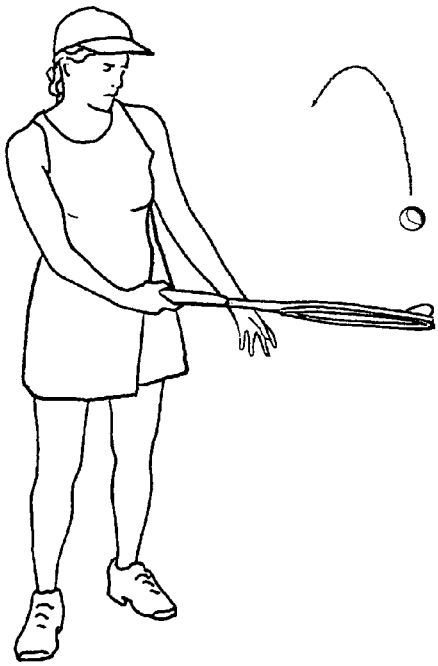
Figure 10:
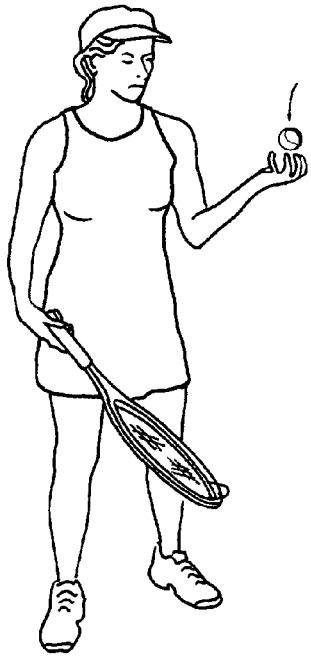

FIGS. 7-10 illustrate one way the Scoop can be used conveniently to retrieve a tennis ball from the playing surface. The racquet 1 is first placed against the ball 2, the ball preferably being slightly to the right of a right-handed player, and positioned to roughly center the ball 2 on the wire loop 3. As shown in FIG. 8, the player then sweeps the racquet to her left, carrying the ball on the wire loop and raising it upwards in a single smooth motion. As the racquet sweeps vertically, the ball leaves the racquet and flies into the air (FIG. 9), so that the player can readily catch the ball in her left hand as shown in FIG. 10. For left-handed players, the Scoop is mounted on the other side of the centerline of the head of the racquet and the direction of the motions reversed. While the present inventor favors this particular method, variations on the particular motion employed should be considered within the scope of the invention. Some players, for example, would rather not toss the ball into the air but instead simply pick the ball off the racquet as it sweeps upwards.

The principal advantage of using the Scoop to retrieve the ball over previous methods is that the ball can be swept up off the court with a simple, elegant motion thereby allowing the player to conserve strength and concentrate better on the game. More particularly, the Scoop does not require a ball retrieval device to be deployed prior to each use, nor returned to a pre-deployed position after use, greatly simplifying its use as compared to the prior art as discussed above. Furthermore, the Scoop is designed so that it is very lightweight, typically a few percent or less of the weight of the racquet itself, and very small in cross-section, so as to have no detrimental effect during normal play, even advanced aggressive play. The wire loop itself does not extend past the periphery of the racquet, which would interfere with some sweeping ground shots, and it is virtually inconspicuous. For the same reason, essentially the only time the wire loop of the Scoop might be struck by a ball during play is in circumstances when the ball would have otherwise hit the rim of the racquet; the resulting trajectory of the ball would be substantially random in either case, so that the presence of the Scoop has essentially no impact on the result of the shot.

The present inventor has built and extensively tested a variety of prototypes to characterize and optimize the various design parameters. General design considerations for the Scoop are discussed first in the following, followed by a detailed description of each particular embodiment.

Figure 5:
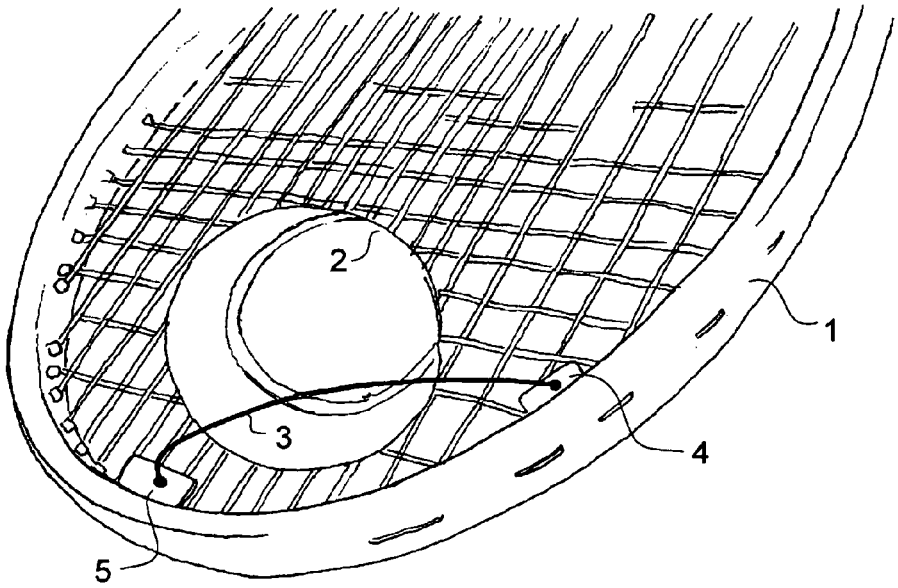
FIG. 5 shows a different perspective view of the add-on Scoop and ball of FIG. 1.
Figure 6:
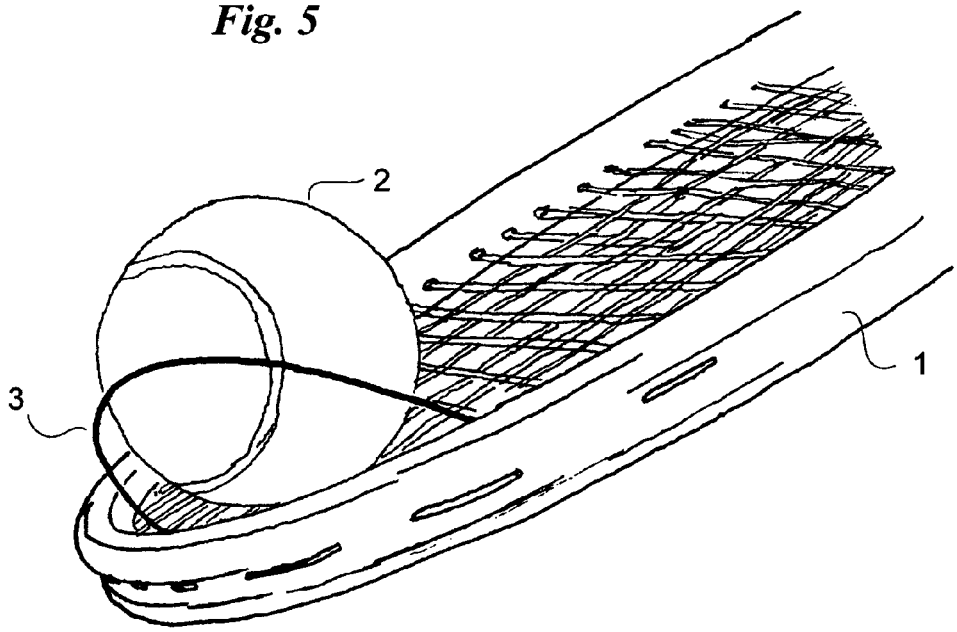
FIG. 6 shows yet another perspective view of the add-on Scoop and ball of FIG. 1.
Figure 11:
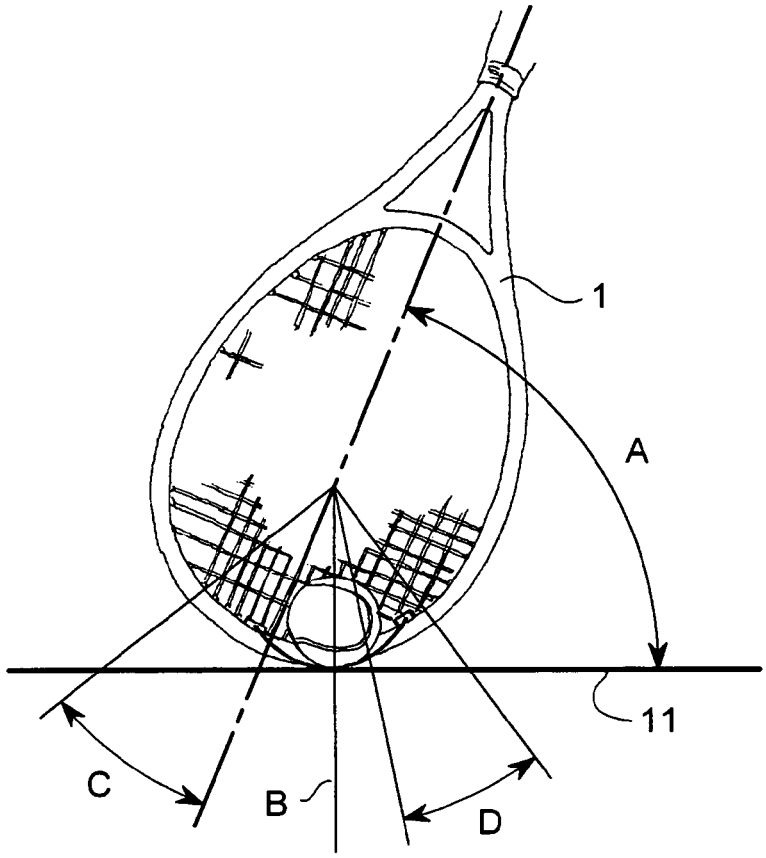
FIG. 11 shows the angle of the racquet with respect to the court surface as the ball is being approached in FIG. 7.

First, experience has shown that the optimum position of the spring wire loop on the racquet is on the end of the head of the racket, so that the player can more easily reach down for the ball, but slightly off-center, as discussed above and as illustrated in FIGS. 1-6. The loop is preferably located off-center on the racquet to best position it with respect to the court surface when first approaching the ball as the player in FIG. 7 is doing. At this moment, as the racquet is extended outward in front of the player, the centerline of the racquet makes an angle A with respect to the court surface 11, as shown in FIG. 11, and the court surface is roughly tangent to the center of the loop, thereby best enabling capture of the ball. In FIG. 11, the angle A between the centerline of the racquet and the court surface shown in FIG. 11 is approximately 67°; clearly this angle will vary somewhat depending on the individual player. In order that the court surface can be approximately centered on the loop, therefore, the loop should be located so that its ends are approximately equally spaced about a line B that is perpendicular to the court surface, or, in the example, makes an angle of 23° to the centerline of the racquet. The exact angle A, that is the angle at which the player scoops up the ball, and the overall size of the loop, which should be at least large enough to conveniently retain a tennis ball as illustrated in FIGS. 5 and 6, are matters of personal preference and can be varied accordingly. Typically one end of the loop is located within 0-30° to one side of the centerline of the racquet (range C in FIG. 11), and the other within 30-60° of the centerline on the other side (range D).

Figure 12:
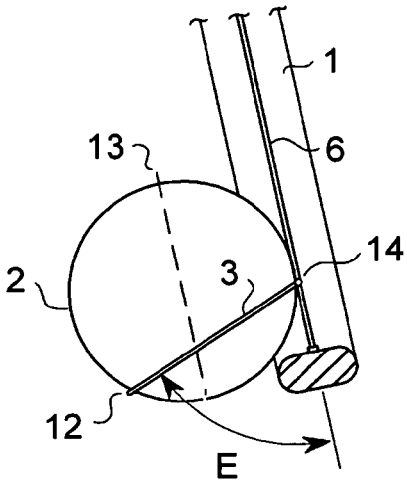
FIG. 12 shows a simplified side view of the Scoop spring wire and ball.

FIG. 12 shows a simplified side view of the Scoop, illustrating the preferred height and angle of the parabola with respect to the plane of the strings 6. For clarity and to simultaneously address all five embodiments the end mounts are not shown; depending on the embodiment, the near attachment point 14 could be located either on the strings 6, as shown, or on a portion of the frame. In FIG. 12 the plane of the parabola 3 forms an exemplary angle E with respect to the plane of the strings 6, and the "peak" 12 of the parabola (that is, its point of maximum spacing from the strings 6) extends substantially beyond the centerline 13 of the ball 2. The higher the peak, that is, the farther the wire extends past the centerline 13 of the ball, the more securely the ball is retained. Experience has shown, however, that the peak 12 of the parabola need be only just past the centerline 13 of the ball to allow the ball to be swept readily up off the court. The angle E formed between the plane of the loop of wire and the plane of the strings is typically about 68 degrees in embodiments wherein the loop is attached to the strings and may be somewhat less in embodiments wherein the loop is attached to the rim or bumper guard, but can vary through a wide range, e.g. 45-90 degrees. Ideally, the loop angle and position are chosen so that, as shown in FIG. 12, the ball 2 rests between the strings and the wire 3 without touching the racquet frame 1.

Finally, as shown in the various FIGs., it will be appreciated that the wire loop of the Scoop is located such that it is substantially aligned with the corresponding portion of the rim of the head of the racquet when viewed from a direction normal to the plane of the strings, although, as will be apparent from comparing, for example, FIGS. 1 and 2, the loop need not be precisely aligned with the rim of the racquet.

As described, in several embodiments of the Scoop, the loop is made by deforming an initially straight length of wire as the wire is installed on the racquet. Depending on the specific bending forces on the wire as determined by the supports at each end, the particular mathematical definition of the curve shape can vary from approximately parabolic to semi-circular. Other embodiments of the Scoop, particularly, the D-Loop described in detail below, employ wire that has been pre-formed during manufacture into a defined shape which may include the curvature of the loop. In the present context, it is to be understood that in all embodiments "approximately parabolic" or simply "parabolic" is simply a term of convenience that refers to all simple curve shapes ranging from parabolic to semi-circular, including such variations as "flattened parabolic" or partially elliptical.

Further, while several of the preferred embodiments of the invention involve disposition of a straight length of wire between receptacles that securely capture the ends of the length of wire and ensure that it retains its desired parabolic configuration, it is also within the scope of the invention, as discussed more specifically below, to permanently deform the ends of the wire into complex shapes to be secured to cooperatively-shaped retainers affixed to the strings or frame of the racquet.

It will be apparent that if a tennis ball accidentally strikes the wire during play, tremendous forces will be exerted on the wire; the wire must be able to withstand such forces without permanent deformation. For this reason, the wire is preferably made out of a metal alloy known by the trade name Nitinol and manufactured by a number of companies, including Memry Corporation of Bethel, Conn. Composed of 55-56% nickel and 44-45% titanium, Nitinol gets its name from the metals in it (nickel and titanium) and the laboratory that first recognized its potential (the Naval Ordinance Laboratory). The particular alloy employed in the present invention is generally known as "Superelastic Nitinol" in the industry and is similar to steel spring wire, otherwise known as "music wire", but has the unique ability to recover its preset shape even after drastic distortion. It can be stressed eight to ten times more than ordinary spring steel without permanent deformation. While Nitinol exhibits desirable characteristics for the present application, other flexible wires of either metal or polymer composition should also be considered within the scope of this invention.

The Add-On Scoop

Figure 13:
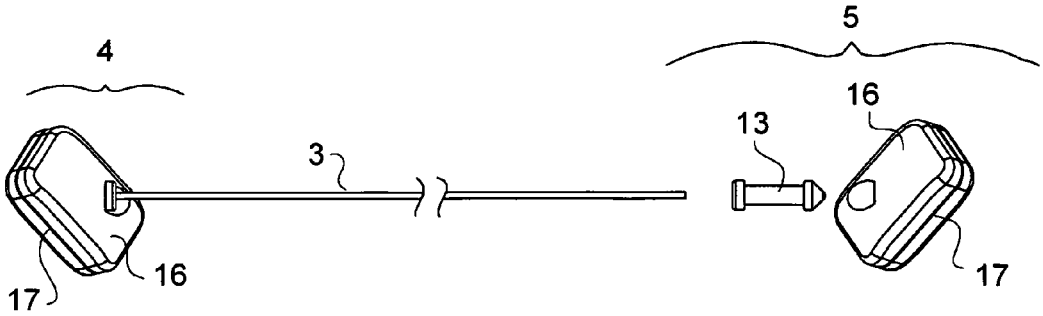
FIG. 13 shows a partially-exploded view of the preferred embodiment of the add-on Scoop in its relaxed, uninstalled shape.

Turning now to specific discussion of the several embodiments of the invention, FIG. 13 shows the preferred embodiment of the add-on Scoop of FIG. 1 in its relaxed shape prior to installation, and illustrates one end mount 4 assembled and the other end mount 5 disassembled. Each end mount in this preferred embodiment consists of a wire end cap 13 which is molded out of a relatively hard polymer and serves to contain the end of the wire, and a softer resilient mount 16 adapted with slots 17 around the periphery to flexibly attach it to the racquet strings, as illustrated in more detail by FIGS. 15 and 16. The spring wire 3, preferably a straight length of 0.040-0.050 inch diameter Superelastic Nitinol wire, is first either pressed or glued into the wire end caps 13. The end caps 13 are then pressed into recesses in the resilient mounts 16 to complete the end mount assemblies 4 and 5. The uninstalled add-on Scoop, therefore, comprises a straight wire with end mounts on each end that can be rotated with respect to each other. When installed on a racquet the wire bends resiliently into the approximately parabolic shape illustrated in FIG. 14.

The resilient mounts 16 are preferably injection molded of 50 durometer silicone rubber and comprise slots 17 extending around the periphery of mount 16 to flexibly attach the mounts 16 to the racquet strings 6. The end mounts 16 are free to rotate to facilitate installation between the strings. The purpose of the end caps 13 is to cover the potentially sharp ends of the wire and prevent them from being pushed through the relatively soft resilient mount 16. For this reason, the end caps 13 are preferably injection molded out of a relatively hard polymer to prevent the wire from breaking through.

Figure 15:
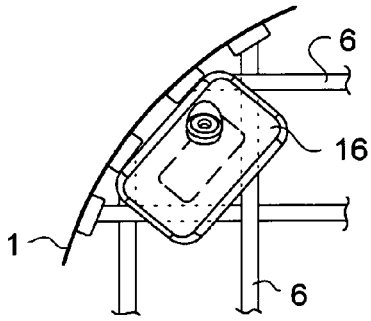
FIG. 15 shows one resilient mount of the add-on Scoop of FIGS. 13 and 14 installed on the rim of the head of a typical tennis racquet.
Figure 16:
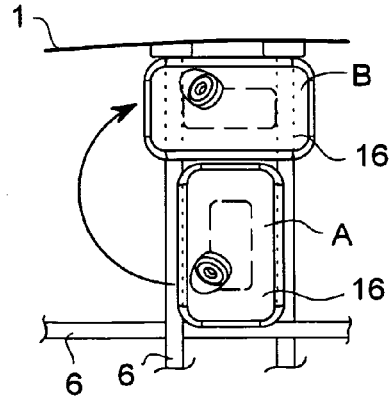
FIG. 16 illustrates the installation of the other resilient mount of the add-on Scoop of FIG. 14 at the top of the tennis racquet.

One convenient method to install the add-on Scoop is illustrated by way of FIGS. 15 and 16, which show the end mounts 16 installed on the strings 6 at the side and the top of the racquet 1 respectively. For clarity the spring wire 3 is not shown in FIGS. 15 and 16. Referring first to FIG. 16, one end mount 16 is inserted vertically between the strings as shown at position A, and then twisted into place as shown at position B; the strings then fit into the peripheral grooves 17, retaining the end mount 16 in the desired position. The other end mount is then installed as shown in FIG. 15 by bending the spring wire and similarly inserting and rotating the second mount 16 into place. The second mount 16 is usually a little more difficult to get into place and typically requires a bit of jogging back and forth to correctly place it.

Modern tennis racquets are commercially available in a wide variety of designs that include various head sizes, shapes and string spacing. The strings may be equally spaced or the spacing may vary across the face of the racquet, typically becoming closer together approaching the center. The strings running parallel to the handle of the racquet may be spaced differently than those running transverse thereto. The string itself is available in a range of diameters (typically 1.2-1.4 mm) and the tension with which racquets are strung can be chosen to achieve the desired playing action. Because of the wide variety of racquet designs available, it may not be possible to design a single pair of resilient mounts that will conveniently fit any racquet. The preferred embodiment mount of FIGS. 13 and 14 could be made available in several different sizes or, alternatively, other resilient mount shapes could be developed to better fit different racquet types or manufacturer brands. The resilient mount of the present invention is similar in design to the popular "dampers" that come with most racquets and which serve to help dampen string vibrations during play. These dampers are available in a wide variety of designs that include roughly rectangular, square and triangular shapes. Although obviously not designed to anchor the ends of the spring wire of the present invention, they are designed to fit snugly and securely between strings and as such represent a range of possible starting points for designs for the resilient mounts of the present invention.

Figure 14:
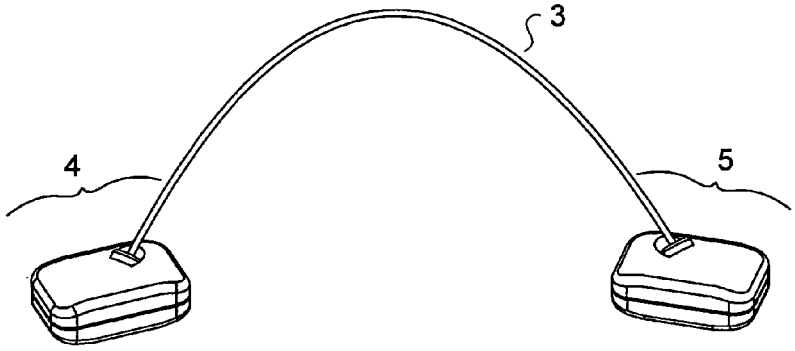
FIG. 14 shows the add-on Scoop of FIG. 13 bent to form an approximately parabolic loop.

The angle between the plane of the parabola formed and the plane of the strings (that is, the angle E exemplified as 68 degrees in FIG. 12) is determined by the compound angle of the recess in the resilient mount that receives the end cap 13 and thus the end of the length of wire. It has been found convenient by the present inventor to make both resilient mounts with the same compound angle but mount them on the spring wire with one inverted with respect to the other. This makes one the mirror image of the other as shown in FIGS. 13 and 14. In some cases it may be desirable to make different compound angles for the two resilient mounts to better fit certain racquets.

As mentioned above, it is also within the scope of the invention to form the ends of the wire into more complex shapes for being received and retained by cooperative mounts.

The Built-In Scoop

A first embodiment of the built-in Scoop of FIG. 3, in which receptacle mounts are fixed to the inside surface of the head of the frame of the racquet, is shown in detail by FIGS. 17-21. Again, only a portion of the racquet frame 1 is shown, and the strings have been omitted for clarity.

Figure 17:
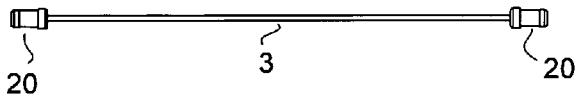
FIG. 17 shows a detailed view of the spring wire assembly of the first embodiment of the built-in Scoop in its fully-extended relaxed shape.
Figure 18:
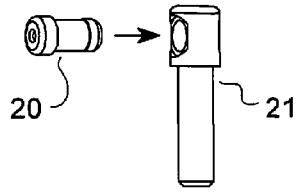
FIG. 18 shows the wire plug cap and the receptacle mount of the first embodiment of the built-in Scoop.

Referring first to FIG. 17, as above, the spring wire 3 is again preferably made of 0.040-0.050 inch diameter Superelastic Nitinol and has plug caps 20 either glued or pressed onto each end. The purpose of these plug caps 20 is twofold; first to cover the potentially sharp cut end of the spring wire and second to contain the ends of the spring wire, to allow them to be plugged into receptacles 21 as illustrated in FIG. 18. The cap plugs 20 and the receptacle mounts 21, both preferably injection molded out of a relatively hard polymer, should be designed so that the plug "snaps" into place, being reliably held in place when inserted and yet relatively easy to remove when needed.

Figure 19:
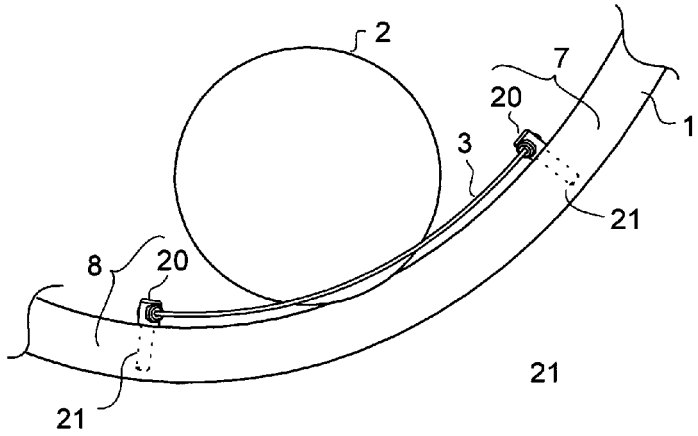
FIG. 19 shows a simplified frontal view of the first embodiment of the built-in Scoop.
Figure 20:
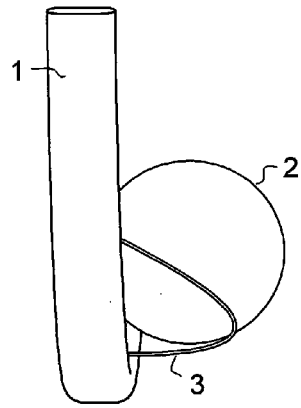
FIG. 20 shows a side view of the built-in Scoop of FIG. 19.

FIG. 19 shows this embodiment of the Scoop after installation, the spring wire 3 with attached plug caps 20 having been inserted into receptacle mounts 21, and the spring wire forming an approximately parabolic loop that retains ball 2 against the strings (not shown). FIG. 20 shows the assembled loop from a different perspective. Receptacle mounts 21 are permanently affixed to the racquet frame 1 by press-fitting, gluing or the like into holes in the frame 1, so as to hold them securely and prevent them from twisting in place. One means to prevent twisting, used by the present inventor in prototypes, is to press a pin made of a short length of small diameter Nitinol wire through mating holes drilled through the edge of the racquet frame 1 and the base of receptacle mounts 21. In this manner the receptacle mounts are held in place and prevented from rotating without the use of adhesives. Other methods to properly affix the receptacle mounts 21 to the frame will be apparent to those skilled in the art. This embodiment is in contrast to the add-on Scoop because it requires the receptacle mounts to be installed or "built-in" to the frame of the racquet itself, which would most conveniently be done during manufacture of the racquet.

Figure 21:
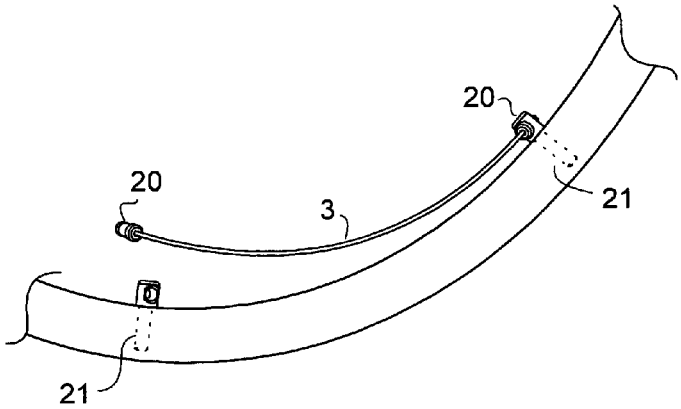
FIG. 21 shows the built-in Scoop of FIG. 19 with one end of the spring wire unplugged from the receptacle.

To remove the Scoop wire assembly, the player simply grips the wire 3 and pulls first one end out of the receptacle mount as illustrated in FIG. 21, and then pulls the other end out. In this manner the player can choose to play without the Scoop if so desired. Also, the wire can be readily replaced if it becomes damaged, and different length wires can be used according to the player's preference.

One particular advantage of this first embodiment of the built-in Scoop is that the receptacle mounts are inserted into holes that are on the inside of the racquet frame in line with the string holes. Because of the need for string holes, racquets are typically designed so that the structural integrity of the racquet under the extreme stress of advanced play is not compromised by the presence of drilled string holes; the two additional holes needed to accommodate the Scoop mounts, particularly as they are in the same plane as the string holes, will not unduly affect the structural integrity of the frame.

A second embodiment of the built-in Scoop of FIG. 4 is shown in FIGS. 22-26. Again, only a portion of the racquet frame 1 is shown and the strings have been omitted for clarity.

Figure 22:
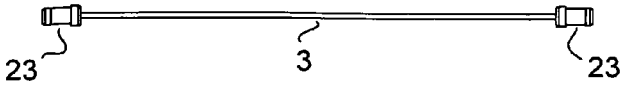
FIG. 22 shows a detailed view of the spring wire assembly of the second embodiment of the built-in Scoop in its fully-extended relaxed shape.
Figure 23:
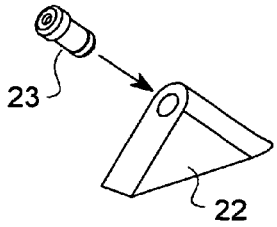
FIG. 23 shows the wire plug cap and the resilient receptacle mount of the second embodiment of the built-in Scoop.

Referring first to FIG. 22, the spring wire 3 is again preferably made of 0.040-0.050 inch diameter Superelastic Nitinol and has plug caps 23 either glued or pressed onto each end, this assembly being essentially the same as shown in FIG. 17. The purpose of these plug caps 23 (which may be identical to plug caps 20 of FIGS. 17-21) is again twofold; first to cover the potentially sharp cut end of the spring wire and second to adapt the ends of the spring wire to allow them to be plugged into receptacles 22 as illustrated in FIG. 23. In this embodiment, the plug cap 23 is preferably injection molded out of a relatively hard polymer and the receptacle 22 is preferably injection molded out of a softer polymer such as polyethylene or silicone so as to form resilient mounts. As before, the plug cap 23 and the receptacle 22 should be designed so that the plug presses in easily but definitively, being reliably held in place when inserted and yet relatively easy to remove when desired.

Figure 24:
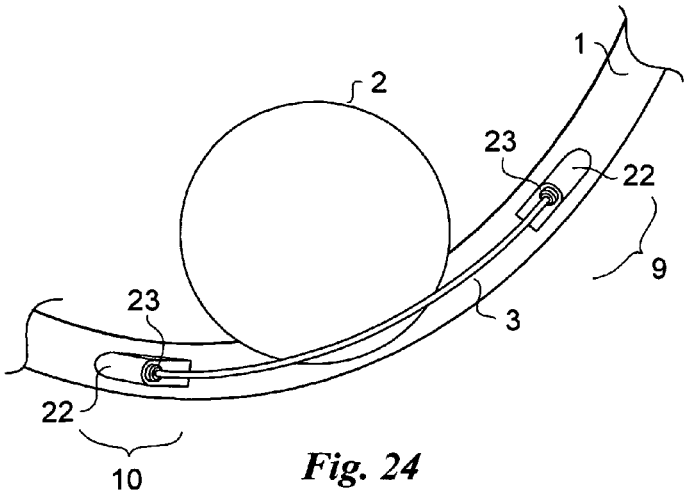
FIG. 24 shows a simplified frontal view of the second embodiment of the built-in Scoop.
Figure 25:
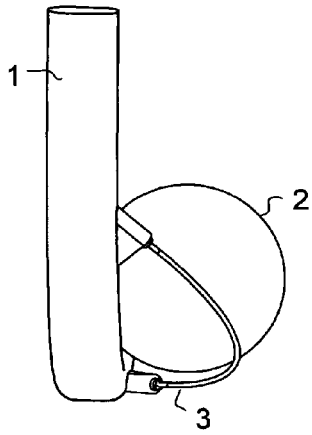
FIG. 25 shows a side view of the built-in Scoop of FIG. 24.

FIG. 24 shows this second embodiment of the built-in Scoop as assembled, the spring wire 3 with attached plug caps 23 inserted into receptacles 22, so that the spring wire forms an approximately parabolic loop that retains ball 2 against the strings (not shown). FIG. 25 shows the assembly from a different perspective. Resilient receptacles 22 are permanently affixed to the racquet frame 1 by press-fitting, molding-in-place, gluing or the like.

Again, the precise manner in which the resilient mounts 22 are attached to the frame 1 is best addressed by the tennis racquet designer so as to be integrated into the process of manufacturing the racquet; various effective methods of doing so will be apparent to those skilled in the art of making tennis racquets. One method employed by the present inventor in prototypes is to mold the resilient mount 22 in place on the racquet frame 1, with resilient material extending downward through one or more small holes in the racquet frame and expanding outward inside the frame so as to securely capture the mount in place when the resilient material cures. Because this embodiment may involve the addition of several small holes or slots in the top of the racquet rim, attention must be paid to structural considerations, so as to avoid compromising the structural integrity of the racquet during aggressive play.

Figure 26:
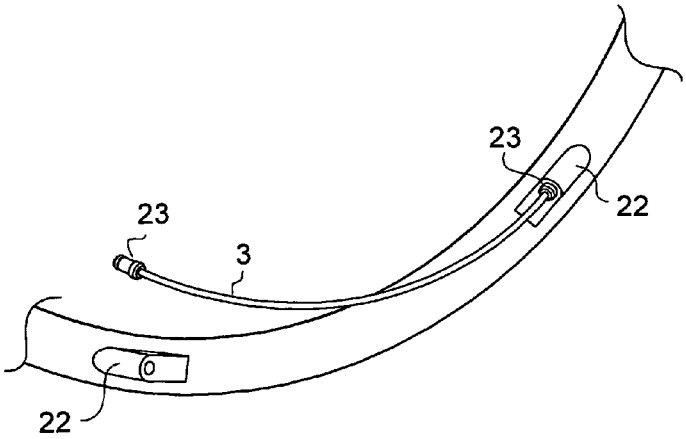
FIG. 26 shows the built-in Scoop of FIG. 24 with one end of the spring wire unplugged from the receptacle.

To remove the Scoop wire assembly from the racquet in this embodiment, again the player simply grips the wire 3 and pulls one end out of the resilient receptacle mount 10 as illustrated in FIG. 26, and then pulls the other end out. And as before, the player can choose to play without the Scoop if so desired. Also, the wire can be readily replaced if it becomes damaged and different length wires can be used according to the player's preference.

The Bumper Scoop

The "Bumper Scoop" refers to embodiments of the Scoop that employ the racquet's bumper guard to retain the spring wire. More specifically, most modern racquets have a plastic bumper guard that serves to protect the racquet head from scraping the court surface, and which is formed to integrally comprise tubular grommets that protect the strings from abrasion as they pass through the racquet frame. Since the bumper guard is made to fit the profile of the racquet frame very closely, and since it is tightly secured to the racquet by the strings, it is sufficiently reliably attached to be useful in securing the Scoop spring wire to the racquet.

Figure 27:
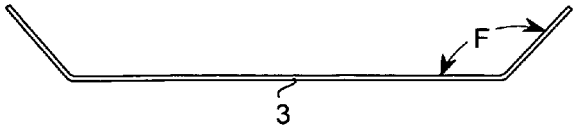
FIG. 27 shows the pre-formed spring wire of a first embodiment of the bumper Scoop in its relaxed shape.

The first embodiment of the bumper Scoop employs the pre-formed spring wire illustrated in FIG. 27 in combination with a bumper guard that has been modified at manufacture to provide two molded-in receptacles, each preferably comprising two retaining channels, to receive the opposed ends of the wire. Two examples of specially adapted bumper guards are shown in cross section in FIGS. 28 and 29, which are as taken along the line H-H in FIG. 30. The differences therebetween are discussed below. These simplified cross sections show a typical racquet frame 1 with the modified bumper guard 24 in place.

Again, the spring wire 3 making up the loop is preferably made of 0.040-0.050 inch diameter Superelastic Nitinol wire. However, in this embodiment the ends of the wire are preformed to retain a bend of F degrees at each end. The spring wire 3 is best pre-formed under a known controlled temperature process to avoid degrading the material strength and elasticity at the bends. This process for Nitinol is commonly known as "shape setting" and the relevant information is provided by a number of companies including Memry Corporation mentioned earlier.

Figure 28:
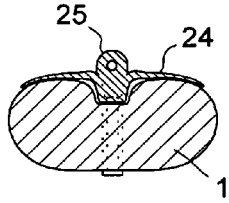
FIG. 28 shows a cross-sectional view taken along the section line H-H in FIG. 30 of a centered version of the bumper Scoop with no spring wire installed.
Figure 30:
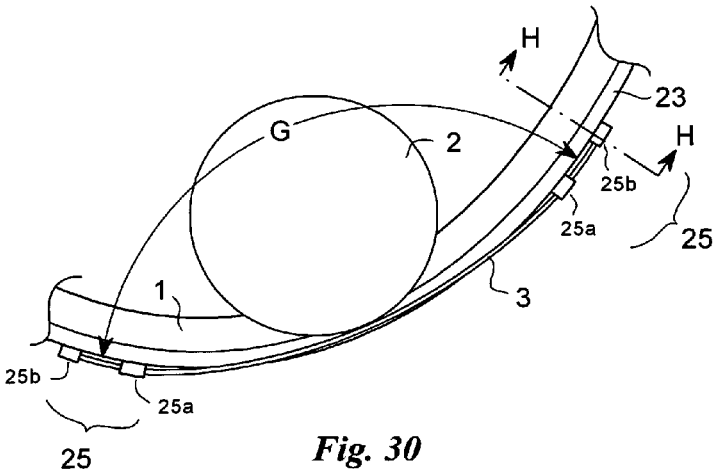
FIG. 30 shows an installed bumper Scoop cradling a tennis ball.
Figure 32:
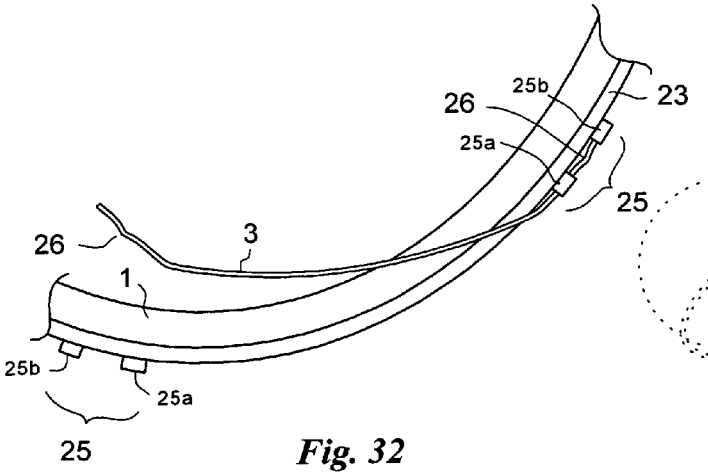
FIG. 32 shows the bumper Scoop of FIG. 30 with dimples added, and with one end of the wire removed from the corresponding receptacle.
Figure 31:
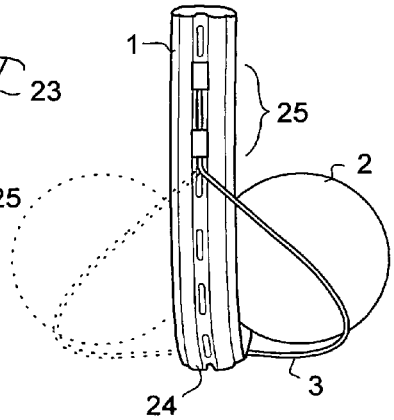
FIG. 31 shows a side view of the bumper Scoop of FIG. 30.

A racquet equipped with the modified bumper guard 24 of FIG. 28 is shown in FIGS. 30-32. The receptacles 25 are both molded integrally with the bumper guard 24 so as to define two tubular channels 25*a* and 25*b* to receive each end of the wire loop. The first tubular channel 25*a* of each receptacle 25 is preferably made to allow the wire to pass through, while the second 25*b* is formed with a blind hole to prevent the wire end from protruding. The spring wire 3 is then installed on the racquet in the manner shown in FIG. 32, by inserting one end into the two channels 25*a* and 25*b* of the receptacle 25 at one end, flexing the wire a bit and then inserting the other end into the two channels 25*a* and 25*b* of the opposed receptacle 25. Thus inserted, the ends of the spring wire form an angle G between them, this angle being a function of the size and shape of the racquet head, of the length of the wire, and of the angle F. The internal stresses produced in the spring wire cause the wire to form a loop and to maintain the desired angle E (see FIG. 12) with respect to the string plane, although the wire ends remain free to rotate in the receptacles. The angle E of the loop with respect to the string plane and the shape of the loop depend on the angles F and G which can be adjusted as needed.

Furthermore, as illustrated with dotted lines in FIG. 31, if the receptacles are centered on the string plane when the loop is flipped from one side of the racquet to the other it will snap to the same angle E on the other side. In this manner, the Scoop can easily be switched from right-handed to left-handed ball retrieval. Also, if the ball happens to hit the spring wire loop during play, it will absorb the energy of the impact in a very controlled manner, by simply flipping to the other side. The player can simply flip the loop back to continue retrieving balls on the same side of the racquet.

The modified bumper guard 24 in FIGS. 30-32 is shown in cross-section in FIG. 28. As can be seen, the receptacles 25 in this version are molded into the center of the bumper guard 24, thereby allowing the spring loop 3 to flip back and forth symmetrically, as discussed above. Because these receptacles 25 are molded into the center of the bumper guard 24, they must be located so as to avoid interfering with the stringing of the racquet. Since a significant length of spring wire must be secured in order for the spring wire to reliably return to the same angle with respect to the string plane, and since each portion of the receptacle can be no longer than the distance between the string holes, each receptacle 25 is preferably made to comprise two wire-receiving channels 25*a* and 25*b*, as above.

Because the spring wire loop of the Scoop is under bending stress when installed, it exerts an axial outward force on the receptacles; accordingly, the loop of wire is securely retained during play, such that the holes in the receptacles can be molded slightly larger than the spring wire diameter to allow easy slip fit during installation and removal. Occasionally, however, the loop may be inadvertently struck by the tennis ball during play in such a way that the loop is pulled out of the receptacle at one end, so that it may be advantageous to further secure the spring wire in place. Referring to FIG. 32, this can be accomplished by adding pre-formed "dogleg"-form dimples 26 at each end of the spring wire 3 located so as to lie between the two channels 25*a* and 25*b* of each receptacle 25 after installation. The dimples 26 should be sized and shaped with respect to the resiliency of the material of the channels in the bumper guard, so that the channels will retain the wire securely while permitting easy installation through the inner channels. Alternatively, a tight-fitting resilient tube or a secured collet (not shown) can be slipped over the wire 3 between the channels 25*a* and 25*b* during installation to better retain the spring wire 3. It is also within the invention to insert the spring wire 3 into the receptacles 25 before stringing the racquet and then to loop the string over the spring wire in the gap between the two receptacle sections while stringing. This will, of course, prevent the spring from flipping back and forth. Other means may be employed as well to insure that the wire remains in place under all playing conditions.

Figure 29:
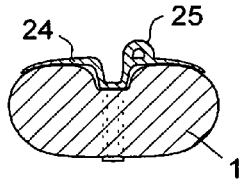
FIG. 29 shows a cross-sectional view taken along the section line H-H in FIG. 30 of an offset version of the bumper Scoop with no spring wire installed.

A variation of the bumper guard 24 of FIG. 28, shown in cross section in FIG. 29, shows the receptacles 25 molded off-center with respect to the string plane. As the receptacles 25 are now not in line with the string holes, they can be located anywhere along the racquet perimeter. The receptacles 25 can each also be formed as one long tube instead of being divided into two channels 25*a* and 25*b*. It may, however, be advantageous to nonetheless provide the receptacles 25 as two channels, in order to be able to employ similar locking mechanisms to prevent the wire 3 from coming out. With the receptacles off-center, the movement of the loop will be restricted with respect to being flipped back and forth between symmetric positions, but advantages for shock absorption and storage may still be provided.

In each of the foregoing embodiments of the Scoop of the invention, the parabolic length of wire making up the Scoop comprised a single length of wire, the ends of which were confined to cause the length of wire to take the desired parabolic shape. In a somewhat different approach disclosed in the following, the parabolic loop of the Scoop is instead part of a pre-formed closed loop of spring wire, shaped like a capital "D", referred to as the "D-loop" herein. In the D-loop approach, the parabolic loop of wire that retains the ball is formed by the curved portion of the "D", while the straight portion of the "D" is constrained to lie along the rim of the racquet, which causes the parabolic section to take its desired shape and angle with respect to the plane of the strings.

The D-loop approach has several advantages. One is that as the closed spring wire loop has no exposed ends there is little danger of injury to the players, even if the loop becomes dislodged or disengaged during play. Further, as will appear below, the D-loop approach may be simpler and less expensive to implement over a wide range of racquet designs.

Figure 33:
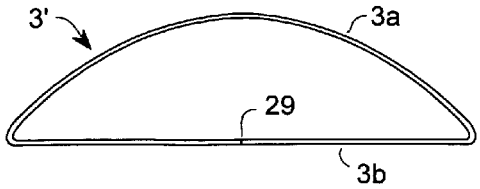
FIG. 33 shows the spring wire D-loop of a second version of the bumper Scoop.
Figure 34:
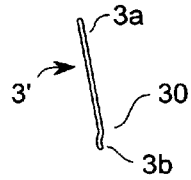
FIG. 34 shows a side view of the spring wire D-loop.
Figure 35:
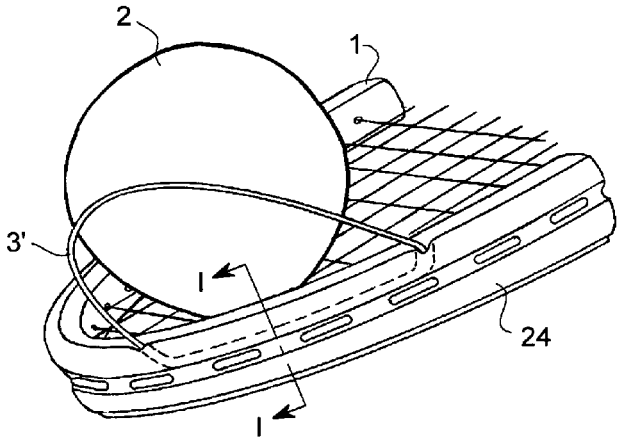
FIG. 35 shows the D-loop installed on a racquet and cradling a ball.
Figure 39:
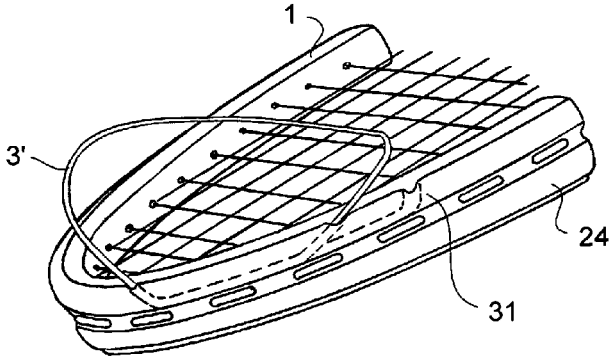
FIG. 39 shows the installed D-loop spring wire of FIG. 35 partially removed.

FIGS. 33-51 illustrate several different embodiments of the D-loop approach. In a first embodiment, several variations of which are shown in FIGS. 33-38, the D-loop is retained by the bumper guard shown in cross-section in FIGS. 36-38. The basic D-loop 3' is shown in FIGS. 33 and 34. FIG. 35 shows the spring wire D-loop 3' installed under a modified bumper guard 24 with a tennis ball 2 resting against it as it would appear during use. FIG. 39 shows a racquet with the D-loop 3' partially installed (or removed). As can be seen in FIGS. 35-38, the basic requirement is to provide an interstitial channel between the lip of the bumper 24 and the frame of the racquet 1 into which the D-loop 3' can snap into place, with small clearance notches made to clear the ends of the parabolic section of the D-loop 3'. Since bumper guards are designed to press this lip firmly on the racquet frame, a small channel that closely fits the D-loop wire is all that is needed to reliably retain the D-loop during play. This channel may preexist in some cases, or may require modification of one or both of the guard and racquet frame. Where necessary, suitable modifications can be implemented either by the racquet manufacturer at the factory, or can be made to existing racquets and/or bumper guards in the field, e.g., in a specialty tennis store or pro shop.

The general shape of the D-loop 3' is shown from the front in FIG. 33 and from the side in FIG. 34. As indicated, it simply comprises a loop portion 3*a*, which forms the parabolic loop in use, and a spine portion 3*b*, which is constrained to lie along the rim of the head of the racquet. Again, the D-loop 3' is made of a section of spring wire, preferably made of 0.040-0.050 inch diameter Superelastic Nitinol wire. The section of wire is shape-set into the approximate form shown, and the mating ends of the wire in the middle of the spine are connected together at 29 by means of butt welding, overlap welding or any other suitable means such as, for example, gluing a length of each end into a thin-walled tube. The additional minor bends 30 shown in the side view of FIG. 34 are made as needed to accommodate various racquet frame shapes and to adjust the angle the wire loop makes with the string plane.

Figure 36:
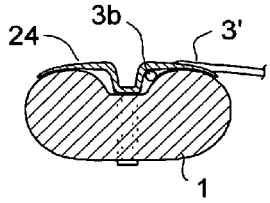
FIG. 36 shows a cross-sectional view taken along section line I-I in FIG. 35 illustrating a first method for using a bumper guard to retain the D-loop, with the D-loop installed.
Figure 37:
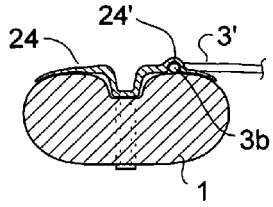
FIG. 37 shows a cross-sectional view taken along section line I-I in FIG. 35, showing a second method for modification of a bumper guard to retain the D-loop, with the D-loop installed.
Figure 38:
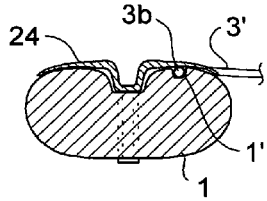
FIG. 38 shows a cross-sectional view taken along section line I-I in FIG. 35, showing a third method for modification of a bumper guard to retain the D-loop, with the D-loop installed.

The cross-sectional views of FIGS. 36-38 show various ways in which the interstitial channel between the bumper guard and frame of the racquet receiving the D-loop 3' can be implemented. Referring to FIG. 36, a schematic cross-section though the rim of a typical modern tennis racquet 1, the rim of the head of the racquet essentially comprises two members which are roughly circular in outline, with a flat connecting strip extending between them, through which holes are drilled for strings to pass. The bumper guard 24 is held securely in place by the racquet strings, and the lip of the bumper guard 24 extends nearly to the edge of the frame 1 to protect it. Some bumper guard designs with relatively sharp internal corners, such as shown in FIG. 36, incidentally provide a small opening between the bumper guard 24 and the racquet frame 1 that can be used as a channel to receive the spine 3*b* of the D-loop 3'. In this case, the bumper guard 24 need only be modified to provide entrances where the wire at the corners of the of D-loop 3' exits the bumper guard 24, as shown at 31 in FIG. 39. For bumper guard/racquet combinations that do not have such a interstitial gap between the rim of the racquet and its bumper guard 24, the bumper guard 24 can instead be modified to incorporate a molded-in raised channel 24' as shown in FIG. 37. Alternatively, the bumper guard can be left as is and the channel be implemented as a groove 1' in the racquet frame 1 as shown in FIG. 38. Since the depth of the groove 1' would ideally be slightly less than the diameter of the wire, the presence of the groove 1' would likely have little or no effect on the structural integrity of the racquet frame 1.

In all three examples a closely-fitted channel is provided for the spine 3*b* of the D-loop to snap into when installed. The lip of the bumper guard 24 keeps the wire in the channel and the tension naturally resulting from bending the flat spine 3*b* to lie along the contour of the racquet perimeter keeps the wire from vibrating during play, and together with the minor bends 30 of FIG. 34, constrains the loop portion 3*a* of the D-loop 3' to take the desired angle E with respect to the string plane.

As can be understood from FIG. 39, installation of the D-loop begins by pressing either corner of the D-loop into the corresponding groove entrance, one of which is pointed out at 31. These entrances are ideally flared a bit to facilitate insertion of the corner of the D-loop. The spine 3*b* of the D-loop is then successively pressed into place along the groove, possibly with the aid of a simple flat implement lifting the bumper guard lip, until the entire spine 3*b* finds the groove and snaps into place. This tactile snap provides a positive indication that the spine portion 3*b* is properly seated. Removal of the D-loop begins by pulling hard on one end of the loop and then bending the spine and extracting it a little at a time from beneath the lip of the bumper guard.

These channels can be implemented by a racquet manufacturer with minor design changes to either the bumper guard or the racquet frame. Suitable modifications to existing racquet bumper guards could also be made in the field by specialty tennis stores or pro shops employing methods and specialized equipment known in the plastics fabrication industry. For example, the groove in the bumper guard, as in FIG. 37, could be heat-formed by confining a wire-shaped form between the bumper guard and the frame of a strung racquet and then heating the plastic bumper guard to cause it to flow around the wire and thereby create a channel. The heat can come from resistive or "joule" heating of the wire itself or externally from a heat gun, from a specialized heating element or from more sophisticated tools using ultrasonic or infrared energy. It is also within the invention to mill or heat-form the groove of FIG. 38 into an existing racquet frame, for example using a small specialized tool that would clamp to and follow to the racquet frame. While modifications like these could be performed in stores and pro shops, the costs and complications involved may be prohibitive; nonetheless, a significant marketing advantage would clearly be provided if the modifications required could be done quickly and easily even to a fully-strung racquet.

The next three variations of the D-loop approach to the bumper scoop came from the realization by the present inventor that the most practical effective field modification that can be made to an existing bumper guard is to punch openings in it using a simple specialized tool, preferably, a pliers-like punch comprising a thin backing member slipped between the bumper lip and the frame, so that the relatively soft plastic material of the bumper can then be cut with a sharp-edged punch as the pliers are squeezed. Other inexpensive means and methods can also be devised to minimize costs and optimize safety and effectiveness in the present application. The devices shown in FIGS. 40-51 all require only that small punched openings be made in the lip of the bumper guard in order that the D-loop Scoop can be added to an existing racquet.

Figure 40:
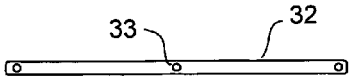
FIG. 40 shows a retention strip that can be used to modify a bumper guard to form a channel.
Figure 41:
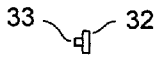
FIG. 41 shows a side view of the retention strip of FIG. 40.
Figure 42:
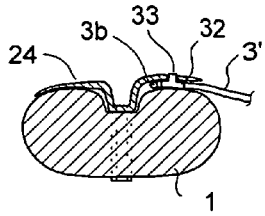
FIG. 42 shows a cross-sectional view through the rim of the head of a racquet and the corresponding bumper guard, with the retention strip of FIG. 40 installed.

FIGS. 40-42 show a retention strip 32 that can be slipped under the lip of the bumper guard 24 and snapped into place, so as to lift the lip of the guard away from the rim of the racquet to provide a channel 34 to retain the spine 3*b* of the D-loop 3' of FIG. 33. The thickness of the retention strip 32 should be on the order of the diameter of the spring wire; it comprises an elongated strip of plastic with, for example, three pins molded integrally into it. To modify a fully-strung racquet to retain the D-loop, one would first punch three holes into the bumper guard 24 at corresponding locations along the periphery of the racquet using a specially designed punch, as above. One would then use a simple thin flat tool to lift and hold the lip of the bumper guard while inserting the spine 3*b* of the D-loop of FIG. 33 under the lip of the bumper guard. One would then slip the retention strip 32 in under the lip, behind the spine; when all three molded pins 33 find the pre-punched holes in the lip, the retention strip 32 will snap into place. It will be noted that the lip will remained raised slightly over the length of the retention strip but this will not impair play, bumper guard protection or the retention of the D-loop.

Figure 43:
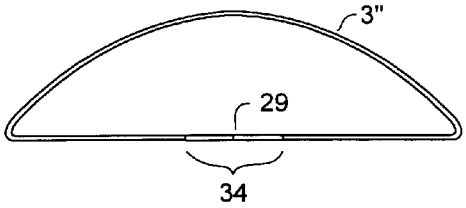
FIG. 43 shows a D-loop spring wire bent to form a raised retention means.
Figure 44:
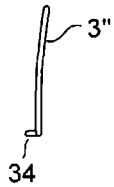
FIG. 44 shows a side view of the D-loop spring wire of FIG. 43.
Figure 45:
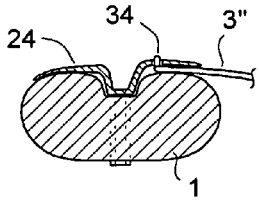
FIG. 45 shows a cross-sectional view through the rim of the head of a racquet and the corresponding bumper guard, with the D-loop spring wire of FIG. 43 installed.

The D-loop 3" of FIG. 43 is the same as the D-loop 3' of FIG. 33 but with one or more sections 34 in the spine of the loop raised out of the plane of the loop, as shown in FIG. 44. The raised section(s) 34 fit into slot(s) cut out of the bumper guard 24, so as to retain the D-loop 3". As can be seen in the cross-section of FIG. 44, the raised section(s) 34 are formed by simply pre-forming the wire to bend up and then back down. This D-loop 3" is shown installed on a racquet in FIG. 45. To install it one would first punch elongated slot(s) in the bumper guard at the desired location(s) using a specialized tool, then lift the lip of the bumper guard 24 using a simple thin flat tool, and insert the spine of the D-loop until the raised section(s) 34 of the D-loop 3 snap into the cutout hole(s) in the bumper guard 24. It will be noted that the lip of the bumper guard in this version will also be deformed somewhat to accommodate the portion of the spine of the D-loop that is not protruding through the cutout slot(s).

Figure 46:
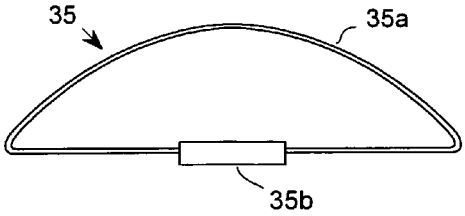
Figure 47:
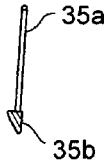
FIG. 47 shows a side view of the D-loop spring wire of FIG. 46.
Figure 48:
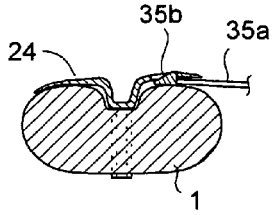
FIG. 48 shows a cross-sectional view through the rim of the head of a racquet and the corresponding bumper guard with the D-loop spring wire of FIG. 46 installed.

FIGS. 46-48 show yet another version of a D-loop, one that avoids the step of welding the ends of the length of spring wire together. In this case, the D-loop 35 comprises a length of spring wire 35*a* and a plastic retention device 35*b* which serves both as a retention device and a means to complete the loop, the wire ends being glued or molded into the ends of the device. As shown in the side view of FIG. 47 and the cross-section of FIG. 48, which shows the D-loop installed the retention device 35*b* can be shaped so as to aid insertion under the lip of the bumper 24. Again, once aligned with a pre-punched slot in the lip, the retention device 35*b* snaps into place and as before the bumper guard lip will be deformed slightly to accommodate the remainder of the spine of the D-loop 35. The plastic retention device 35*b* should be flexible enough to conform to the rim of the racquet as it is inserted.

Although the loop of spring wire has been described throughout this application as approximately parabolic in shape, it should be noted that the D-loop can be pre-formed into any shape desired. For example, the wire loop 35 shown in FIG. 46 is slightly flattened which may offer some advantage in ease or repeatability in picking up the ball.

Figure 49:
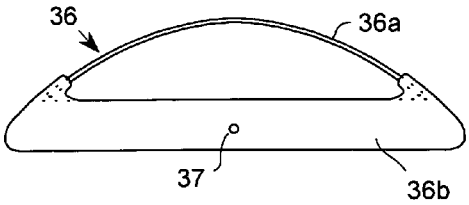
Figure 50:
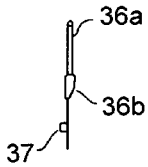
FIG. 50 shows a side view of the D-loop spring wire of FIG. 49.
Figure 51:
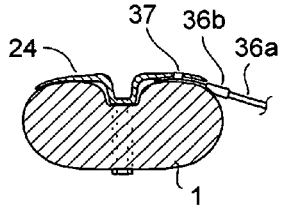
FIG. 51 shows a cross-sectional view through the rim of the head of a racquet and the corresponding bumper guard with the D-loop spring wire of FIG. 49 installed.

The final D-loop variation 36, shown in FIGS. 49-51, comprises a length of spring wire to form the loop portion 36*a*, and a thin strip 36*b* of plastic or metal attached to form the spine portion 36*b*. The advantage of this method is that the strip 36*b* can be made even thinner than the spring wire of loop portion 36*a*, and accordingly when installed will distort the lip of the bumper guard by the least amount. In the case of a plastic strip, the thin strip 36*b* can be molded onto the ends of the spring wire of the loop portion 36*a*, and so as to comprise one or more small pins 37 that snap into pre-punched holes in the lip of the bumper guard. Alternatively, the spring wire could be glued into close-fitting holes in the ends of the strip 36*b*. In both of these cases, it may be advantageous to mold a small amount of curvature into the less-flexible ends of the strip 36*b* that attach to the wire portion 36*a* to better conform to the curvature of the rim when installed. To make the strip 36*b* as thin as possible, it can be fabricated from metal with the spring wire and the pins welded into place. This D-loop is installed in a similar manner to the versions previously described.

It is also within the scope of the invention to secure the spine of the D-loop to the rim of the racquet directly, that is, other than by securing it to the bumper guard.

Yet another embodiment of the Bumper Scoop, shown in FIGS. 52-57, makes use of a spring wire with preformed triangular loops at each end, each wire end terminating in a resilient T-shaped coupling member. Because of the T-shaped coupling member, this embodiment is referred to herein as the "T-loop". In this version, the triangular end assemblies serve as supports that snap into place between the bumper guard and the racquet frame in much the same manner as the spine on the D-loop version, as previously discussed, but, in the embodiment shown in detail herein, are secured by passing the hypotenuse of the triangular end sections over retaining strips that are secured between the lip of the bumper guard and the racquet frame.

More specifically, in the course of testing various Scoop prototypes, the present inventor has found that many tennis players prefer to use their own racquet and are usually reluctant to switch to another racquet equipped with a Scoop, even if offered free of charge. In order to get the Scoop in the hands of players, therefore, it is advantageous to be able to readily fit a Bumper Scoop to the player's own racquet, and to be able to easily add or remove it from the racquet, without any need for specialized tools. The specific T-loop embodiment described below is particularly well-adapted to that task.

Figure 52:
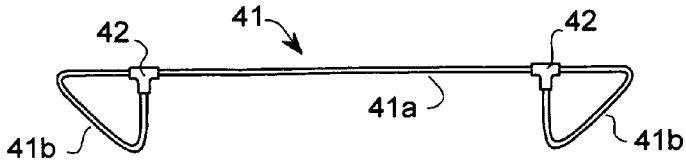
FIG. 52 shows a T-loop spring wire assembly.
Figure 53:
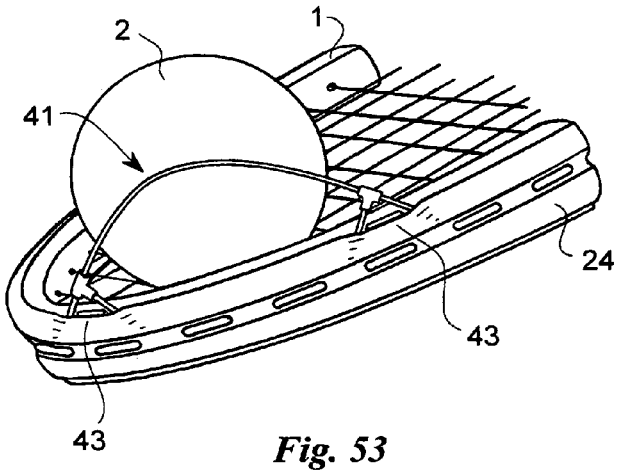
FIG. 53 shows the T-loop installed on a racquet and cradling a ball.
Figure 54:
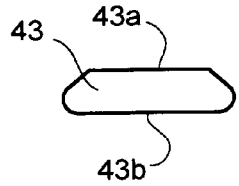
FIG. 54 shows a retaining strip for the T-loop.
Figure 55:
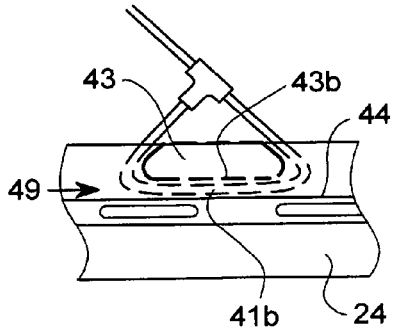
FIG. 55 shows the installed position of the retaining strip of FIG. 54 with relation to the bumper guard and the T-loop spring wire.
Figure 56:
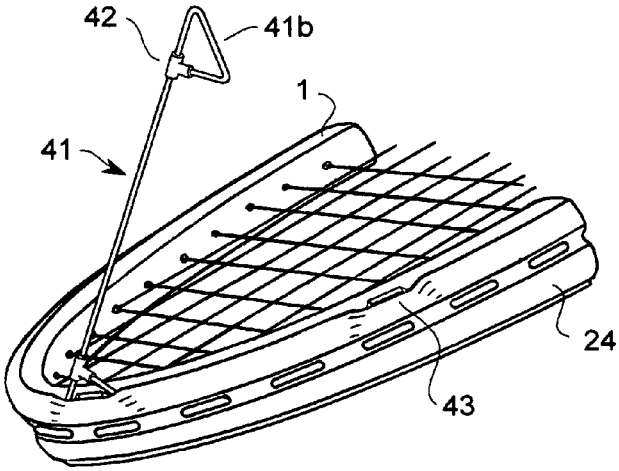
FIG. 56 shows the installed T-loop spring wire of FIG. 53 partially removed.

FIGS. 52-56 illustrate the T-loop and one method that can be used to adapt a racquet to accept it. More specifically, FIG. 52 shows the uninstalled T-loop assembly. FIG. 53 shows it installed under a bumper guard 24 with a tennis ball 2 resting against it as it would appear during use. FIG. 56 shows it with only one end inserted, as is the case during installation or removal of the T-loop from the racquet. FIG. 54 shows a retaining strip that is attached to the bumper guard, e.g., by gluing, to form a channel to receive the hypotenuse 41*b* of each end section of the T-loop. FIG. 55 shows details of the assembly of the ends of the T-loop to the racquet.

Referring now to FIG. 52, the T-loop 41 comprises a preformed length of spring wire and two T-shaped resilient couplers 42. Each end of a straight length of wire, again preferably 0.040-0.050 inch diameter Superelastic Nitinol wire, is preformed into the approximately right-triangular shape shown, such that each end defines a hypotenuse section 41*b*. The wire can be bent by heating the wire and bending it in a jig adapted for that purpose. Each of the bent-over ends of the length of wire is attached to the straight section of the wire 41, preferably by means of a resilient coupler 42, preferably made of a strong but resilient polymer such as polyurethane. The couplers 42 define a through-bore for receiving the central section 41*a* of the length of wire and a blind bore at approximately a right angle to the through-bore for receiving the ends of the length of wire. Although shown in the shape of a "T" in this preferred embodiment, any other shape may be suitable for esthetic or other reasons.

One purpose of the resilient coupler 42 is to prevent the ends of the wire from being exposed during play, as might occur if the Scoop were hit hard with a ball and became dislodged from the racquet. For this reason, it is important that the couplers 42 be made of a strong, tear-resistant material, such as for example polyurethane, and that the ends of the wire be securely attached inside the couplers 42, which can be accomplished by molding the couplers 42 directly on to the wire, or by gluing the couplers 42 to the wire.

One advantage of the T-loop approach over the D-loop version is that the triangular shape of the wire at each end provides stiffer support of the section 41*a* of the wire (FIG. 52) that becomes the parabolic loop once installed. The support is stiffer because two sections of wire support the parabolic loop at the resilient mount instead of one. This effectively shortens the length of the parabolic loop and makes it more resistant to deflection during the action of picking up a tennis ball 2. Another advantage of the T-loop is that the resilient mount 42 serves to dampen vibrations in the parabolic section 41*a* of the spring wire, thereby reducing noise produced by vibrations in the spring wire during play. To reduce manufacturing cost, or if the dampening afforded by the resiliency of the couplers is not needed, the couplers could alternatively be made of a hard plastic or any other suitable material.

FIG. 53 illustrates the T-loop 41 installed on a racquet under the bumper guard 24. The ends of the T-loop are held in place by means of retaining strips 43 that are glued or otherwise attached to the underside of the bumper guard 24, forming channels 49 (FIG. 55) that receive the hypotenuse of the T-loop. The upper edges of the strips 43*a*, as shown in FIG. 54, are just visible under the bumper guard 24 in FIG. 53.

The retention strip itself 43 is illustrated in a top view in FIG. 54 and in relation to the bumper guard 24 and the triangular wire section when installed in FIG. 55. The retention strip 43 is a thin piece of plastic that when glued to the underside of the bumper guard 24 and positioned as shown in FIG. 55, forms a channel 49 between the inside edge of the strip 43 and the inner lip 44 of the bumper guard 24. This channel 49 receives the hypotenuse section 41*b* of the triangular section of wire, which is then retained under the edge of the bumper guard. The strip is preferably made of flexible but relatively hard plastic such as polyurethane or nylon and of a thickness less than or equal to the diameter of the spring wire. Cyanoacrylate adhesives serve well to glue the plastics mentioned to the materials typically used to manufacture bumper guards.

The outline, thickness and profile of the retaining strip are optimized to make it quick and easy for a player to insert and remove the T-loop. The outline shape of the retaining strip 43 illustrated in FIG. 54 works well but can be varied as needed, the purpose of the strip 43 being primarily to form the channel 49 to retain the wire. The thickness of the strip 43 is preferably on the order of one-half to two-thirds the diameter of the wire to facilitate insertion and removal of the wire. Appropriate bevels (not shown) are preferably added to the edges 43*a* and 43*b* of the retaining strip 43 to make insertion and removal of the hypotenuse 41*b* as smooth as possible.

More specifically, FIG. 56 shows the T-loop 41 with one end not yet installed, but with a retention strip 43 having been glued to the underside of the bumper guard 24, performed so as to avoid gluing the retention strip to the racquet frame. To install the end of the T-loop, the coupling member 42 is grasped between one's fingers, and the hypotenuse 41*b* is pressed between the racquet frame 1 and the retention strip 43, deforming the bumper guard 24 with the attached retention strip 43 up away from the frame 1 so that the wire hypotenuse 41*b* can be admitted therebetween. As the wire hypotenuse 41*b* is further pushed inwardly, it slides between the retaining strip 43 and the frame 1 until it falls into the channel 49, audibly "snapping" into place. The bumper guard then returns to substantially its original position, retaining the hypotenuse in the channel 49. Because the hypotenuse 41*b* is forced to conform to the curvature of the rim 1 of the racquet when installed, the resulting tension in the wire serves to retain the wire firmly in place under the bumper guard lip, thereby preventing the wire from rattling during play. To remove either end of the T-loop, the triangular section is rotated about the hypotenuse 41*b* by pulling the coupling member 42 outwardly away from the frame 1 until the edge of the bumper guard lifts enough to allow wire hypotenuse 41*b* to come out of the channel 49 and be slid out from between the retention strip 43 and the frame 1.

A simple variation of the retaining strip, not shown, is make it wider than the width of strip 43 of FIGS. 54 and 55, and fold it lengthwise, the crease being disposed in the same location with respect to the bumper guard as the edge 43*a* of strip 43 in FIG. 54. The perimeter of the bottom portion of the creased strip thus formed would preferably resemble the outline of the retaining strip 43 as shown in FIGS. 54 and 55. The bottom portion would then be glued to the underside of the bumper guard 24 as described previously, and the added top portion is then folded over the edge of the bumper guard and glued to the outside of the bumper guard.

Another variation of the retaining strip is to glue a retaining strip on to the racquet frame instead of the underside of the bumper guard. The view through the bumper guard shown in FIG. 55 remains the same and a channel 49 is likewise formed to retain the wire hypotenuse. The only difference is that the wire hypotenuse now slips between the retaining strip and the bumper guard instead of between the racquet frame and the retaining strip.

Structures comparable to the retaining strips in either version can alternatively be molded directly into the bumper guard or formed in the racquet frame during manufacture of the racquet, likewise defining channels to receive the hypotenuses at the ends of the T-loop.

Another way to provide a channel to receive the hypotenuse and which avoids the use of glue would be to provide a metal or plastic spring clip to fit over and be secured to the edge of the bumper guard. The edge of the clip (analogous to edge 43*b* in FIGS. 54 and 55) would be made thick enough to define a channel between the edge of the clip and the inside edge 44 of the bumper guard 24 to accept and retain the wire hypotenuse 41*b*. Instead of using glue, such a clip could be held in place by any combination of spring force, crimps into the plastic, rivets or the like. Alternatively, the top of the spring clip could be made to extend across the top of the entire bumper guard, so as to be retained by spring force exerted between the opposed edges of the bumper guard, securing the clip in place and preventing its coming off during play.

Figure 57:
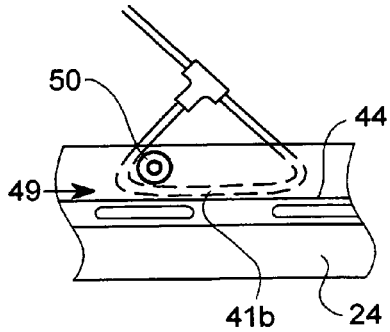
FIG. 57 shows an eyelet installed in the bumper guard with relation to the bumper guard and the T-loop spring wire.

One particularly convenient retention method that requires no gluing operation is to use two conventional rolled-flange brass eyelets, as commonly used to reinforce holes in fabric or paper. Eyelets 50, when installed in the bumper guard 24 as illustrated in FIG. 57, serve to retain the hypotenuse 41*b* of the wire, as discussed previously, by forming a short channel between the eyelet 50 and the inner lip 44 of the bumper guard 24. The thickness of the underside rolled flange of the eyelets 50 is preferably selected to be on the order of one-half to two-thirds the diameter of the wire and can be augmented as needed with a washer or ring. In contrast to the retention strip 43 of FIG. 55, the eyelets 50, as shown, retain only the inner corners of the triangular loops instead of the entire length of the hypotenuses 41*b*. This is sufficient to retain the Scoop in place because internal stress produced in the spring wire 41*a* when deformed into a parabola tends to push the triangular loops outwardly, that is, away from one another. The spring bias thus provided urges the corners of the triangular end sections of the wire up against the eyelets 50, and urges the hypotenuses 41*b* against the inner lip 44 of the bumper guard 24, securely retaining them in their desired positions.

Conventional eyelets comprise a cylindrical barrel portion with one end already formed into a flange. After insertion into a hole, the other end of the cylindrical barrel portion of the eyelet is deformed to form a second flange, using either a pliers-like or impact-type forming tool, capturing the eyelet in place. Accordingly, to install the eyelets 50 in the bumper guard 24, holes are first punched through the bumper guard using a suitable tool, the holes being sized to receive the straight barrel of the uninstalled eyelet. The barrel of each eyelet is then inserted in the corresponding hole, preferably with the preformed flange under the bumper guard, and is secured in place by using the forming tool to 'set' the eyelet, that is, to roll the end of the protruding straight barrel to form a flange on the outer surface of the bumper guard.

Yet another readily available retention method that also requires no glue is to simply staple a conventional or specially adapted staple into the bumper guard with its inner edge disposed along a line corresponding to edge 43*b* in FIG. 55, preferably with the piercing legs of the staple folded on the underside of the bumper so that only the smooth top of the staple is exposed. The folded edge of the staple on the underside of the bumper guard then serves to define a channel to accept and retain the wire hypotenuse.

Although several specific embodiments of the retention means for the T-loop version are described in detail here, it will be appreciated that any convenient means, including those described previously for retaining the spine of the D-loop, can be used to form a channel to retain the wire hypotenuses of the T-loop.

In installing any of the embodiments of the Scoop which require deformation of the bumper guard it may be useful to pre-heat the bumper guard with a heat-gun to soften the plastic. This is already a common practice in tennis shops to aid in installing new tight-fitting bumper guards on racquets.

It should be appreciated that tennis racquet designs change every season and many different designs are already in use, so that a wide variety of different approaches are needed to best market the invention to both racquet manufacturers and directly to players as an add-on product. It should also be recognized that although six distinct embodiments of the Scoop and a number of variations thereon have been shown, the basic idea disclosed in the present application is that of attaching a spring wire to a racquet to form a loop that can be used to retrieve a ball from the court surface, and that many variations in the specific design can be made without departing from the scope of the invention as defined in the following claims. Further, as mentioned above, although the preferred embodiment of the invention has been described in connection with tennis equipment, the invention has similar applicability to other racquet sports in which the player is repeatedly faced with the chore of picking a ball up from the playing surface.

Therefore, the scope of the invention should not be limited by the above exemplary disclosure but only by the following claims.

What is claimed is:

1. A ball retrieving device for attaching to the strings of a racquet, comprising:

a length of wire, and a pair of mounting devices adapted to be securely affixed to the strings of the racquet, and comprising structure for receiving and retaining the ends of the length of wire, wherein the length of the length of wire and the spacing of the mounting devices when affixed to the strings of the racquet are chosen cooperatively so that the wire is deformed into an approximately parabolic loop that extends away from the plane of the racquet strings at least one-half the diameter of a corresponding ball, in an outwardly direction, toward the edge of the racquet.

2. The device of claim 1 wherein each of the mounting devices is a generally flat member formed of a resilient material and having a slot around its periphery into which pairs of adjacent strings of the racquet are received, so that the mounting device is retained between the pairs of adjacent strings.

3. The device of claim 1, further comprising end caps affixed to each end of the spring wire, and wherein said mounting devices each have recesses formed therein to receive and securely retain said end caps.

4. The device of claim 1, wherein the wire is spring wire.

5. The device of claim 4, wherein the spring wire is made of nickel-titanium alloy.

6. The device of claim 1, wherein the loop formed by the wire lies in a plane forming an angle of between 45 and 90 degrees to the plane of the strings.

7. A ball retrieving device for attaching to a rim of a head of a racquet comprising:

a length of wire, and a pair of mounting devices adapted to be securely affixed to the rim of the head of the racquet at first and second locations spaced from one another along the rim of the head of the racquet, said mounting devices comprising structure for receiving and retaining the ends of the length of wire, wherein the length of the wire and the spacing of the mounting devices when affixed to the rim of the racquet are chosen cooperatively so that the wire is deformed into an approximately parabolic loop that extends away from the plane of the racquet strings at least one-half the diameter of a tennis ball in an outwardly direction, toward the edge of the racquet, and wherein a first one of the mounting devices is affixed to the rim of the head of the racquet at a first location within about 0° and about 30° of a centerline of the racquet on one side thereof, and the second of the mounting devices is affixed to the rim of the head of the racquet at a second location within about 30° and about 60° of the centerline of the racquet on the opposite side thereof.

8. The device of claim 7, wherein the mounting devices each comprise a recess for receiving an end cap affixed to the ends of the length of wire.

9. The device of claim 7, wherein the mounting devices are affixed to the inside of the rim.

10. The device of claim 7, wherein the mounting devices are affixed to the outer surface of the rim.

11. The device of claim 7, wherein the wire is spring wire.

12. The device of claim 11, wherein the spring wire is made of nickel-titanium alloy.

13. The device of claim 7, wherein the loop formed by the wire lies in a plane forming an angle of between 45 and 90 degrees to the plane of the strings.

14. A ball retrieving device attached to the rim of the head of a racquet having a bumper guard, comprising:

a length of wire bent near each end thereof such that end portions of the length of wire makes an angle to a central portion thereof, and first and second wire receptacles built into the bumper guard for receiving and retaining the end portions of the length of wire, said receptacles being located at first and second positions spaced from one another along the rim of the head of the racquet, wherein said receptacles are such that said end portions of the length of wire are constrained to lie along the rim of the head of the racquet, and wherein the angles by which said end portions of the wire are bent, the length of the central portion of the length of wire, and the first and second positions on the rim of the head of the racquet are chosen cooperatively so that the wire defines a loop that extends away from the plane of the racquet strings by a distance equal to at least one-half the diameter of said ball, and such that the loop of the wire is substantially aligned with the rim of the head of the racquet when viewed in a direction normal to the plane of the strings of the racquet.

15. The device of claim 14, wherein a first one of the receptacles is affixed to the rim of the head of the racquet at a first location within about 0° and about 30° of a centerline of the racquet on one side thereof, and the second of the receptacles is affixed to the rim of the head of the racquet at a second location within about 30° and about 60° of the centerline of the racquet on the opposite side thereof.

16. The device of claim 15, wherein each of said receptacles comprises two channels spaced from one another along the rim of the head of the racquet.

17. The device of claim 16, wherein said end portions of the length of wire are further permanently deformed so as to define a retention device retained between said channels of each of said receptacles.

18. In combination, a racquet, and a ball retrieving device adapted to be cooperatively secured with respect to the rim of the head of the racquet, said ball retrieving device comprising:

a length of wire formed to make a closed loop generally in the shape of a capital D, said D-shaped loop comprising a loop portion and a spine portion, and a device for securing the spine portion of the D-shaped loop with respect to the rim of the head of the racquet, such that the spine portion of the D-shaped loop is constrained to lie along the rim of the head of the racquet, and the loop portion of the D-shaped loop forms a generally parabolic loop extending away from the plane of the racquet strings by a distance equal to at least one-half the diameter of a ball, and such that the loop of the wire is substantially aligned with the rim of the head of the racquet when viewed in a direction normal to the plane of the strings of the racquet.

19. The combination of claim 18, wherein said combination further includes a bumper guard secured to a rim of a head of the racquet, and wherein said spine portion of the D-shaped loop is confined in a channel disposed between the bumper guard and the rim of the head of the racquet.

20. The combination of claim 19, wherein said channel is a space existing between the rim of the head of a particular racquet and the corresponding bumper guard.

21. The combination of claim 19, wherein said channel is molded into the undersurface of the bumper guard.

22. The combination of claim 19, wherein said channel is formed in the rim of the head of the racquet.

23. The combination of claim 19, wherein entrances are formed in the bumper guard to permit passage of portions of the D-shaped loop extending between the spine and loop portions thereof.

24. The combination of claim 18, wherein the D-shaped loop is located such that one end of the loop portion is within about 0° and about 30° of a centerline of the racquet on one side thereof, and the second end of the loop portion is within about 30° and about 60° of the centerline of the racquet on the opposite side thereof.

25. The combination of claim 18, wherein said device for securing the spine portion of the D-shaped loop with respect to the rim of the head of the racquet, such that the spine portion of the D-shaped loop is constrained to lie along the rim of the head of the racquet, comprises a retention device for securing the spine portion of the D-shaped loop in a desired position under the bumper guard.

26. The combination of claim 25, wherein said retention device comprises an elongated member having a plurality of locating pins formed therein to be received within cooperating apertures in the bumper guard, whereby the spine portion of the D-shaped loop can be inserted beneath the bumper guard, followed by said elongated member, whereby when said pins are received by said apertures said D-shaped loop is secured with respect to the head of the racquet.

27. The combination of claim 25, wherein said retention device comprises a section of the spine portion of said D-shaped loop that is permanently deformed out of the plane of the remainder of said spine portion, so as to be received in a cooperating slot formed in the bumper guard, whereby said D-shaped loop is secured with respect to the head of the racquet.

28. The combination of claim 25, wherein said retention device comprises a member of larger cross-sectional area than said spine portion that is secured to said portion, so as to be received in a cooperating slot formed in the bumper guard, whereby said D-shaped loop is secured with respect to the head of the racquet.

29. The combination of claim 25, wherein the spine portion of said D-shaped loop retention device comprises a flat member to which the ends of the loop portion of said D-shaped loop are assembled, and wherein one or more locating pins are fixed to said flat member to be received within cooperating apertures in the bumper guard, whereby said D-shaped loop is secured with respect to the head of the racquet.

30. A ball retrieving device to be attached to the rim of the head of a racquet having a bumper guard, comprising:

an initially straight length of wire the ends of which have been bent so as to form triangular end portions at each end thereof, with the ends of the wire then having been secured to a straight center section thereof, each of said triangular end portions defining a hypotenuse section;

first and second channels being formed in the rim of the racquet under the bumper guard for receiving the hypotenuse sections of said triangular end portions of the length of wire, whereby the hypotenuse sections are retained in the channels by the edges of said bumper guards, said channels being located at first and second positions spaced from one another along the rim of the head of the racquet, and wherein the length of the center section of the length of wire and the first and second positions on the rim of the head of the racquet are chosen cooperatively so that when installed the central section of the length of wire defines a loop that extends away from the plane of the racquet strings by a distance equal to at least one-half the diameter of the ball, and such that the loop of the wire is substantially aligned with the rim of the head of the racquet when viewed in a direction normal to the plane of the strings of the racquet.

31. The device of claim 30, wherein said channels are formed by retaining strips under the bumper guard, disposed such that inner edges of said retaining strips are spaced from inner edges of the bumper guard, providing channels therebetween sized to securely receive said the hypotenuse sections of said triangular end portions of the length of wire.

32. The device of claim 31, wherein said retaining strips are formed of plastic of a thickness less than or equal to the diameter of the wire.

33. The device of claim 31, wherein said retaining strips are adhesively bonded to the bumper guard.

34. The device of claim 31, wherein said retaining strips are molded into the bumper guard.

35. The device of claim 31, wherein said retaining strips are adhesively bonded to the rim of the racquet.

36. The device of claim 30, wherein said channels are formed by eyelets installed in the bumper guard, disposed such that flanges of the eyelets are spaced from inner edges of the bumper guard, providing channels therebetween sized to securely receive said hypotenuse sections of said triangular end portions of the length of wire.

37. The device of claim 30, wherein the ends of the length of wire are secured to the straight center section thereof by T-shaped molded plastic members each having a through-bore through which the central section of the length of wire passes and a second bore at substantially a right angle to said through-bore for receiving the corresponding end of the length of wire.

38. The device of claim 30, wherein the wire is spring wire.

39. The device of claim 34, wherein the spring wire is made of nickel-titanium alloy.

40. The device of claim 30, wherein a first one of the channels is formed on the rim of the head of the racquet at a first location within about 0° and about 30° of a centerline of the racquet on one side thereof, and the second of the channels is formed on the rim of the head of the racquet at a second location within about 30° and about 60° of the centerline of the racquet on the opposite side thereof.

41. The device of claim 30, wherein the loop formed by the central section of the length of wire is approximately parabolic.

* * * * *